US008939634B2

(12) United States Patent
Leadford et al.

(10) Patent No.: US 8,939,634 B2
(45) Date of Patent: Jan. 27, 2015

(54) EGRESS LIGHTING FOR TWO MODULE LUMINAIRES

(75) Inventors: Kevin Franklin Leadford, Evergreen, CO (US); Carl Gould, Golden, CO (US); Peter K. Nelson, Denver, CO (US)

(73) Assignee: ABL IP Holding LLC, Conyers, GA (US)

( * ) Notice: Subject to any disclaimer, the term of this patent is extended or adjusted under 35 U.S.C. 154(b) by 319 days.

(21) Appl. No.: 13/282,034

(22) Filed: Oct. 26, 2011

(65) Prior Publication Data

US 2012/0063138 A1 Mar. 15, 2012

Related U.S. Application Data

(63) Continuation-in-part of application No. 13/173,788, filed on Jun. 30, 2011.

(60) Provisional application No. 61/360,156, filed on Jun. 30, 2010.

(51) Int. Cl.
*H01R 33/00* (2006.01)
*F21S 2/00* (2006.01)
(Continued)

(52) U.S. Cl.
CPC ..... *F21S 2/005* (2013.01); *F21S 4/008* (2013.01); *F21V 5/04* (2013.01); *F21V 7/0091* (2013.01);
(Continued)

(58) Field of Classification Search
CPC ..... F21S 2/00; F21S 2/005; F21S 4/003; F21S 4/008; F21S 6/004–6/008; F21S 8/00; F21S 8/002; F21S 8/026; F21S 8/028; F21S 8/03; F21S 8/031; F21S 8/038; F21S 8/04; F21S 8/043; F21S 8/046; F21S 8/066; F21V 21/005; F21V 21/02–21/049; F21Y 2101/00; F21Y 2101/02; F21Y 2103/00; F21Y 2103/003; F21Y 2103/006; F21Y 2105/00; F21Y 2105/001–2105/006
USPC ..... 362/145, 153, 217.1–217.17, 225, 362/249.02, 311.02, 647–648, 800
See application file for complete search history.

(56) References Cited

U.S. PATENT DOCUMENTS 4,225,808 A * 9/1980 Saraceni ..... 315/307
5,343,375 A 8/1994 Gross et al.
(Continued)

FOREIGN PATENT DOCUMENTS

WO WO 2012003256 1/2012
WO WO 2013063293 5/2013

OTHER PUBLICATIONS

Non-Final Office Action for U.S. Appl. No. 13/173,873, mailed Jun. 20, 2013, 7 Pages.
(Continued)

*Primary Examiner* — Jason Moon Han
(74) *Attorney, Agent, or Firm* — Kilpatrick Townsend & Stockton, LLP

(57) ABSTRACT

Embodiments of the invention provide for a lighting system for illuminating aisles with shelving. A rail can include a plurality of LEDs that extend along the length of the rail. The rail can be coupled with a node that includes various components along with an egress light source. The LEDs can be used to primarily illuminate the shelving on both or one side of the aisle. The egress light can be used to illuminate the aisle during times of emergency, at night, or when egress may be required.

16 Claims, 27 Drawing Sheets

(51) Int. Cl.

| | |
|---|---|
| ***F21S 4/00*** | (2006.01) |
| ***F21V 5/04*** | (2006.01) |
| ***F21V 7/00*** | (2006.01) |
| ***F21V 15/01*** | (2006.01) |
| ***F21V 15/015*** | (2006.01) |
| ***F21V 27/00*** | (2006.01) |
| ***F21V 29/00*** | (2006.01) |
| ***H05B 33/08*** | (2006.01) |
| *F21S 9/02* | (2006.01) |
| *F21V 33/00* | (2006.01) |
| *F21W 111/06* | (2006.01) |
| *F21Y 101/02* | (2006.01) |
| *F21Y 103/00* | (2006.01) |
| *F21V 23/04* | (2006.01) |

(52) U.S. Cl.

CPC ..... *F21V 15/011* (2013.01); *F21V 15/013* (2013.01); *F21V 15/015* (2013.01); *F21V 27/00* (2013.01); *F21V 29/004* (2013.01); *H05B 33/0803* (2013.01); *F21V 29/2206* (2013.01); *F21S 9/022* (2013.01); *F21V 33/0052* (2013.01); *F21V 33/0076* (2013.01); *F21W 2111/06* (2013.01); *F21Y 2101/02* (2013.01); *F21Y 2103/003* (2013.01); *F21V 23/0442* (2013.01); *Y10S 362/80* (2013.01)

USPC ..... 362/647; 362/225; 362/249.02; 362/800

(56) References Cited

U.S. PATENT DOCUMENTS

| | | | |
|---|---|---|---|
| 5,546,292 | A | 8/1996 | Shemitz |
| 5,628,557 | A | 5/1997 | Huang |
| 5,702,177 | A | 12/1997 | Lin |
| 7,204,620 | B2 | 4/2007 | Yamamoto et al. |
| 7,329,024 | B2 | 2/2008 | Lynch et al. |
| 7,550,931 | B2 | 6/2009 | Lys et al. |
| 7,593,230 | B2 | 9/2009 | Abul-Haj et al. |
| 7,674,010 | B2 | 3/2010 | Griffiths et al. |
| 7,726,840 | B2 | 6/2010 | Pearson et al. |
| 7,934,850 | B2 | 5/2011 | Altamura et al. |
| 8,079,731 | B2 | 12/2011 | Lynch et al. |
| 8,138,690 | B2 * | 3/2012 | Chemel et al. ..... 315/318 |
| 8,226,280 | B2 | 7/2012 | Daily et al. |
| 2003/0081419 | A1 | 5/2003 | Jacob et al. |
| 2003/0137835 | A1 | 7/2003 | Mier-Langner et al. |
| 2004/0051466 | A1 | 3/2004 | Liu |
| 2008/0303661 | A1 | 12/2008 | Chick |
| 2009/0021955 | A1 | 1/2009 | Kuang et al. |
| 2009/0147510 | A1 | 6/2009 | Peng |
| 2009/0154156 | A1 | 6/2009 | Lo et al. |
| 2009/0244925 | A1 | 10/2009 | Snagel et al. |
| 2010/0020527 | A1 | 1/2010 | Fiermuga |
| 2010/0103701 | A1 | 4/2010 | Bartlett et al. |
| 2011/0001436 | A1 | 1/2011 | Chemel et al. |
| 2012/0001554 | A1 | 1/2012 | Leadford et al. |
| 2012/0002406 | A1 | 1/2012 | Leadford et al. |
| 2012/0002414 | A1 | 1/2012 | Gould |
| 2012/0002415 | A1 | 1/2012 | Nelson et al. |

OTHER PUBLICATIONS

Non-Final Office Action for U.S. Appl. No. 13/173,892, mailed Apr. 10, 2013, 8 pages.

Amendment and Response to Office Action for U.S. Appl. No. 13/173,892, filed Aug. 8, 2013 (20 Pages).

Notice of Allowance for U.S. Appl. No. 13/173,892, mailed Aug. 20, 2013 (9 pages).

Amendment and Response to Office Action for U.S. Appl. No. 13/173,873, filed Sep. 4, 2013 (19 Pages).

International Search Report for PCT/US2012/061959, mailed Feb. 5, 2013, 25 pages.

International Application No. PCT/US2011/042488, International Search Report and Written Opinion mailed on Feb. 28, 2012, 12 pages.

International Preliminary Report on Patentability for Application No. PCT/US2012/061959, mailed Apr. 29, 2014 (9 pages).

Non-Final Office Action for U.S. Appl. No. 13/173,788, mailed Jul. 10, 2014 (15 Pages).

* cited by examiner

EGRESS LIGHTING FOR TWO MODULE LUMINAIRES

CROSS-REFERENCES TO RELATED APPLICATIONS

This application is a continuation-in-part of U.S. patent application Ser. No. 13/173,788, filed Jun. 30, 2011 and entitled "Linear Light Fixtures," which claims the benefit of commonly assigned U.S. Provisional Application No. 61/360,156, filed Jun. 30, 2010 and entitled "Project Ion," the entirety of each of which is incorporated herein by reference for all purposes.

BACKGROUND

One common way to light warehouse storage racks is with linear fluorescent lamps mounted end to end. These linear devices are a natural fit for aisle applications in terms of the uniformity of illumination along the length of the aisle and shadow reduction. The size of the fluorescent source however, can result in less than ideal light delivery efficiency and top to bottom uniformity on the racks. Instead, the shelves are typically lit brighter at the top and dimmer at the bottom.

Another way to light warehouse storage racks is with high intensity discharge (HID) light sources (e.g., high pressure sodium and metal halide). The discreet nature and high lumen output (requiring fewer total lamps) make these systems more cost effective in terms of material use, installation, and operation. Optical systems were developed to take advantage of the point source nature of these lamps to improve light delivery efficiency. The relatively small size of these lamps coupled with their high light output, however, can often result in glare. The discreet size and distant spacing from one fixture to the next can also produce strong shadows. HID products used for aisle lighting are typically the same "highbay" fixtures designed to provide uniform horizontal illumination in high-ceiling open industrial areas. These highbays typically have an axially symmetric photometric distribution which, when coupled with distant fixture spacing, leads to poor uniformity along shelves or racks.

Aisle-lighters are a subset of such highbay fixtures. These luminaires typically have reflective inserts or an oblong aperture to create a photometric distribution better suited to the linear geometry and vertical visual task of rack-and-aisle applications. Aisle-lighters can be used to provide higher illuminance on the storage racks with better uniformity than standard symmetric highbays, or similar performance on the racks with greater spacing between luminaires and a subsequently reduced luminaire count. While sometimes achieving improved photometric performance, these products are far from ideal.

A more recent trend in general highbay lighting, and thus by extension aisle lighting, is high efficacy, high lumen output, electronically-ballasted fluorescent lamps (e.g., the 54 W 4' T5HO). These lamps can provide much greater lumen maintenance than HID sources while also providing superior color and "instant on" operation. The size of fluorescent lamps makes it relatively inefficient to control their luminous output in the along dimension. As such, these fixtures are typically not louvered or lensed and thus expose their bright lamps and the reflected images of the lamps to nearly all angles of view. When mounted discretely, this lack of optical control leads to the same illuminance uniformity problem along the racks suffered by HID highbays. If mounted in something closer to an end-to-end format, their size and weight present an added burden from an installation standpoint and typically to the purchase price as well.

BRIEF SUMMARY

Embodiments of the present invention are directed toward various aspects of a linear light fixture. In some embodiments, a linear rail and node lighting system is disclosed. In some embodiments, rails can include a plurality of discreet light sources that are disposed along the length of the rail. An elongated optical element can be included within the rail that can provide a photometric distribution tailored toward aisle and shelf applications according to some embodiments. In some embodiments, the node can include control, external sensing, power, and/or communication circuitry. Nodes can, but do not have to, communicate and/or share power between each other through communication and/or power channels within the rails.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are, further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed toward various aspects of a linear light fixture. In some embodiments, a linear rail and node lighting system is disclosed. In some embodiments, rails can include a plurality of discreet light sources that are disposed along its length. An elongated optical element may be provided that can impart a photometric distribution tailored toward aisle and shelf applications according to some embodiments. The node can include control, external sensing, power, and/or communication circuitry according to some embodiments. Nodes can communicate and/or share power between each other through communication and/or power channels within the rails. While many embodiments are described in conjunction with aisle lighting applications, the embodiments of the invention are not limited to aisle applications. Indeed, the embodiments disclosed herein can be used in any application and/or in any architectural space without limitation. For example, embodiments of the invention can be used in general industrial applications, open area applications, transportation applications (e.g., train stations, airports, etc.), tunnel lighting applications, convention centers, parking garages, etc.

Embodiments of a Lighting System

A lighting system, according to some embodiments of the invention, can include one or more rails and one or more nodes. A rail can house a plurality of light sources (e.g., LEDs) and optical elements (e.g., lenses) as well as any associated thermal management components. The node can be a connective piece that couples with one or more rails and can house the electronic modules for the light sources in the rails, control electronics, power supplies, microprocessors, sensing devices, and/or communication devices. The rails can be thought of as the light engine component and the nodes as the operational or intelligence centers of the combined system. Rails, for example, can come in any number of lengths such as 4', 6', 8', 10', 12', 14', 16', etc. A rail and a node can be, further equipped with mechanisms by which the two components can be easily and intuitively connected to each other and mounted to the building structure to form a linear run of lighting that behaves as a coordinated system that is mechanically, electrically and/or communicatively connected.

Figure 1:
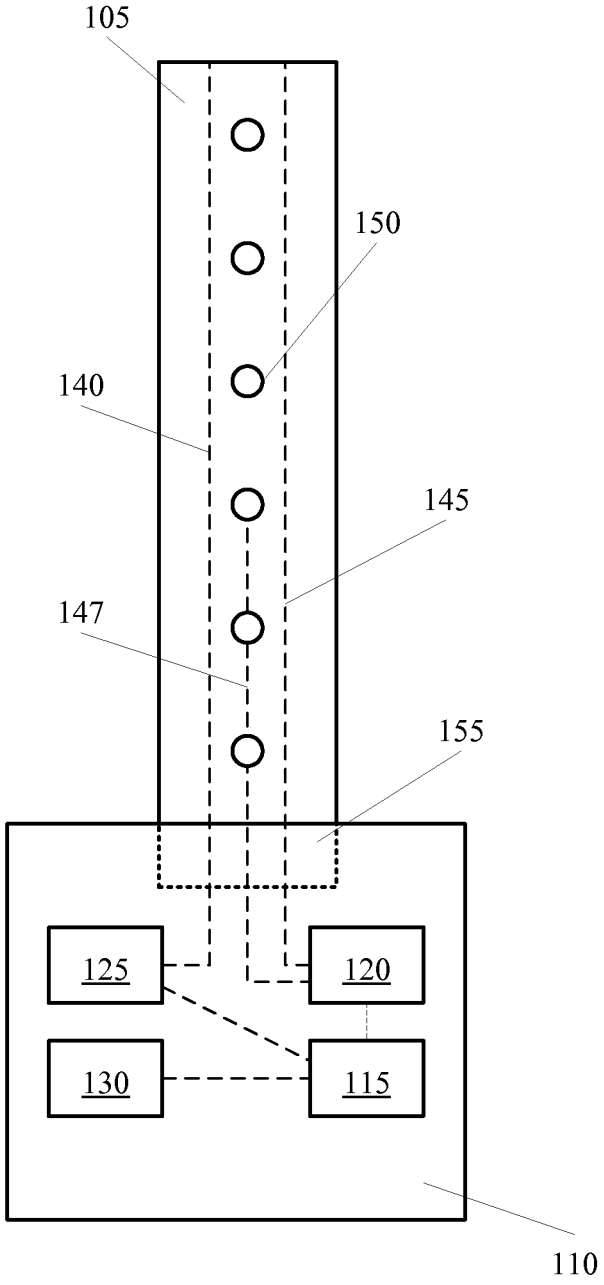
FIG. 1 is a block diagram of a system with a single rail and single node according to some embodiments of the invention.

FIG. 1 is a block diagram of a system with a single rail 105 and a single node 110 according to some embodiments of the invention. Rail 105 includes a plurality of LEDs 150 disposed along the length of rail 105. While LEDs are shown and described throughout this disclosure, any type of light source can be used without limitation. In some embodiments, any type of point-like light source or linear light source can be used. Rail 105 can include multiple power and/or communication channels that run through the length of rail 105. Communication channel 140, for example, can be any type of channel that allows node 110 to communicate with another device on the other side of rail 105. For example, communication channel 140 can be a series of wires, a coaxial wire, or the like. Communication channel 140 can also be a wireless channel.

Power channel(s) may be provided along a portion or the entire length of the rail 105. In the illustrated embodiment of FIG. 1, power channel 145 extends along the entire length of the rail 105. Power channel 145 can provide or receive electrical power from node 110 or from another device (such as an adjacent node, see FIG. 4) through rail 105. Power channel 145 provides an avenue by which to share power between adjacent nodes. Power channel 145 can include multiple power lines within the channel and may deliver either or both AC power or DC power.

Figure 4:
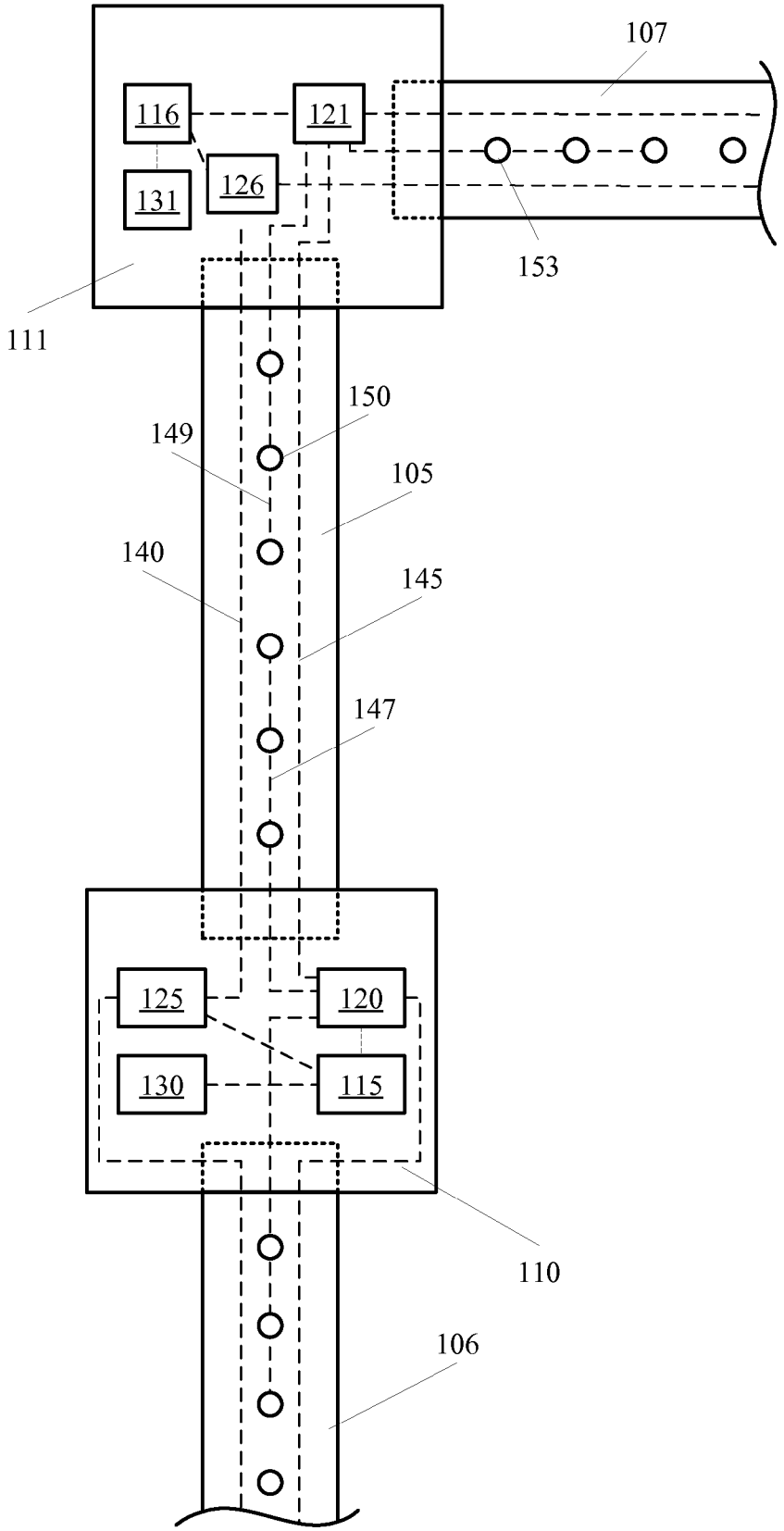
FIG. 4 is a block diagram of two nodes and three rails interconnected according to some embodiments of the invention.

Another power channel (e.g., power channel 147) may be provided to power LEDs 150. Power channel 147 can be coupled with a portion of LEDs 150, as shown, or all LEDs 150. By way only of example, power channel 147 is shown in FIG. 1 coupled only to three LEDs 150 provided on rail 105. Thus, power channel 147 would power those three LEDs 150 on rail 105. In such situations where a power channel is not coupled to all of the LEDs on a rail, it is contemplated that the other LEDs on rail 105 would be powered by an adjacent node via another power channel provided on the rail and coupled to those other LEDs. Such an arrangement is shown in FIG. 4 where the remaining three LEDs only rail 105 are coupled via power channel 149 to node 111.

In some embodiments, power channel 145 can include AC power that is transmitted through rail 105 and power channel 147 can include DC power to power LEDs 150. Rail 105 can be coupled with node 110 at connector 155. In particular, connector 155 can electrically couple communication channel 140 and power channel 145 with node 110. Power channel 145 can include a number of sub channels.

Node 110 can include a number of modules that provide control, power, and/or communication to and/or through rail 105. For example, node 110 can include communication module 125 that is configured to communicate with another device through rail 105. Communication module 125 can also be used communicate with a central processor or computer. Communication module 125 can include both wired and wireless communication techniques. Communication module 125 can be coupled with communication channel 140 through connector 155. Communication module 125 can vary depending on the communication protocol used for communication. For example, if a TCP/IP protocol is used, communication module 125 can packetize and/or depacketize data received from controller 115. Node 110 can also include egress lighting, emergency lighting, exit indicator light, nightlight, etc.

Node 110 can also include sensor 130 coupled with controller 115. Sensor 130 can include one or more of a motion detector, presence or proximity sensor, occupancy sensor, heat sensor, fire sensor, smoke detector, chemical sensor, camera, and/or photosensor. Sensor 130 can be coupled with controller 115. Controller 115 can control operation of node 110, rail 105, other connected rails, and/or other nodes based on a signal(s) from sensor 130.

Node 110 can also include controller 115 that is communicatively coupled with power supply 120 and communication module 125. Controller 115, for example, can control communication sent from communication module 125. Controller 115, for example, can control when electricity is sent from power supply 120. Moreover, controller 115, for example, can control where electricity is sent from power supply.

Node 110 can also include power supply 120 that provides power to LEDs 150 in rail 105 and/or to another node coupled with rail 105. Power supply 120 can be coupled with power channel 145 and power channel 147 through connector 155. Power supply 120 can power all or a portion of the LEDs 150 disposed within rail 105. Power supply 120 can also provide power to another node and/or rail coupled, directly or indirectly, with rail 105. In some embodiments, power channel 145 can tap directly into an external power supply with or without power supply 120. Power supply 120 and/or controller 115 can work singularly or in conjunction to control power to LEDs 150. In some embodiments, power channels 145, 147 can be coupled with controller 115, which may control power to LEDs 150 through power channel 147 and/or to another node through power channel 145.

Power supply 120, for example, can be used to convert external AC power to DC power. Power supply can convert AC power to DC power with any voltage for LED power, controller power, communication module power, sensor power, etc. Any type of power supply known in the art can be used. Standard AC power can depend on the geographic location of the light fixture. For example, in the United States, the standard AC power is 120 VAC. In most parts of Europe the standard AC power is 230 VAC. Thus the type of power converter used can vary depending on the geographic location where the light fixture is used.

Power supply 120 can receive AC power from an external power source. Power supply 120 can provide DC power to some or all the LEDs in rail 105, can provide DC power to another node via power channel 145, and/or can provide AC power to another node via power channel 145. Power supply 120 can also provide power to the various modules and/or other components within node 110.

Figure 2:
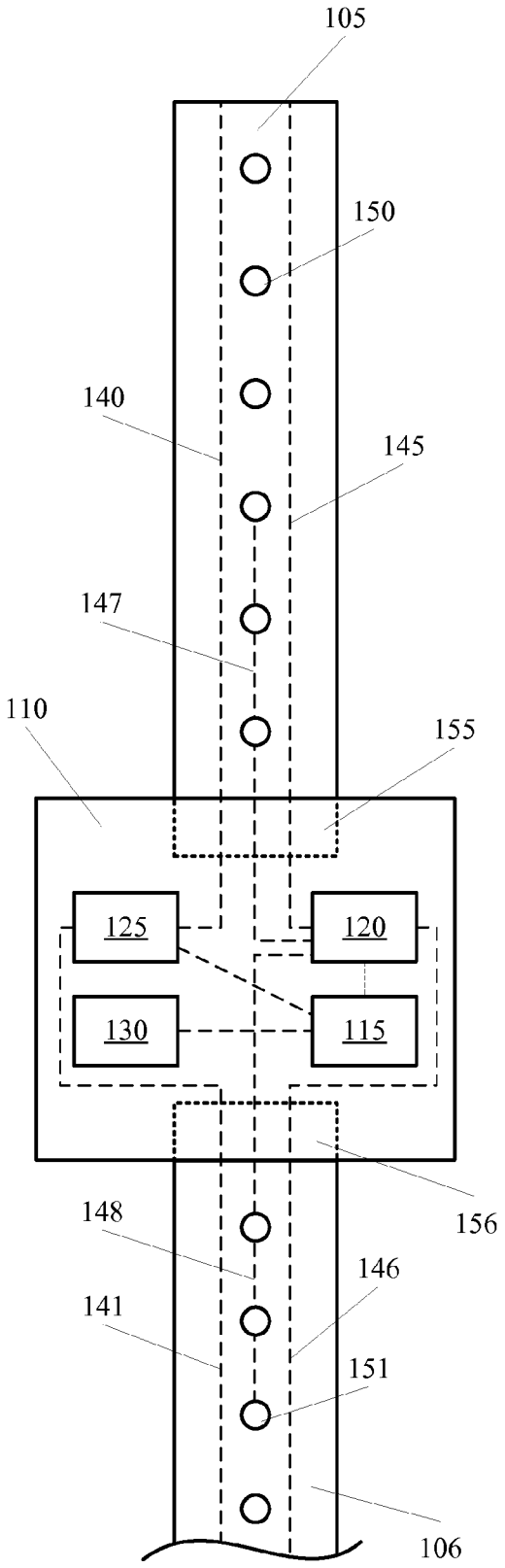
FIG. 2 is a block diagram of a node coupled with two rails according to some embodiments of the invention.

FIG. 2 is a block diagram of node 110 coupled with second rail 106. In some embodiments, rail 106 can be identical to rail 105. In other embodiments, rail 106 can be different than rail 105. Rail 106 can include LEDs 151, communication channel 141, and/or power channels 146, 148. LEDs 151 can be similar to or the same as LEDs 150. Communication channel 141 and power channels 146, 148 can be similar to communication channel 140 and power channels 145, 147, respectively. Communication channel 141 can be communicatively coupled with communication module 125. Power channel 146 can be a power channel and can be electrically coupled with power supply 120.

Power supply 120 can provide power to rail 106 to power LEDs 151 via power channel 148 and/or to another node coupled with rail 106 via power channel 146. In some embodiments, various node modules and/or components can receive AC power without going through power supply 120. Power supply 120 can be coupled with power channels 146, 148 through connector 156. Power supply 120 can power all or a portion of the LEDs 151 disposed within rail 106. Power supply 120 can also power another device coupled with rail 106 using power channel 146. Controller 115 can control whether and/or when electricity is sent through power channel 146 and/or used to power LEDs 151 via power channel 148. Controller 115 can also control communication through rail 106 using communication channel 141. Power supply 120 and/or controller 115 can work singularly or in conjunction to control power to LEDs 151.

Figure 3:
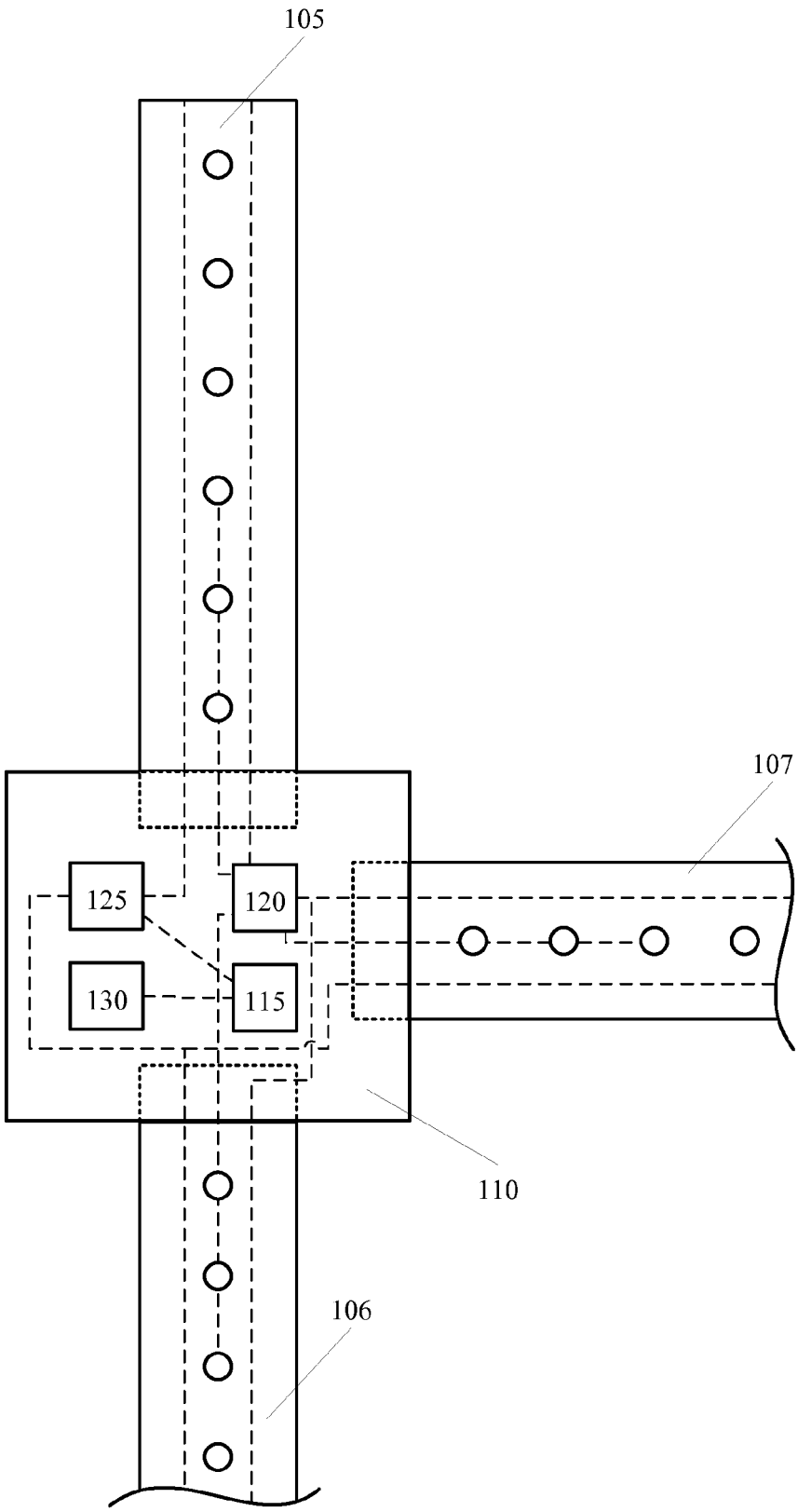
FIG. 3 is a block diagram of a node coupled with three rails according to some embodiments of the invention.

FIG. 3 is a block diagram of node 110 coupled with third rail 107. While node 110 is shown coupled with one, two and three rails in the first three figures, any number of rails can be coupled with node 110. Rail 107 can be similar or different than rails 105, 106. Any number of LEDs and/or channels may be provided. Rail 107 may or may not be coupled with another node.

FIG. 4 is a block diagram of the system shown in FIG. 2 with rail 105 coupled with second node 111. Second node 111 can also be coupled with rail 107. Second node 111 can also include communication module 126, power supply 121, sensors 131, and/or controller 116. Power supply 121 can, for example, receive AC power from node 110 (e.g., from power supply 120) and convert the AC power to DC power. As another example AC power can be tapped at second node 111 and provided directly to power supply 121. Power supply 121 can provide power to some or all of LEDs 150 in rail 105 and/or to some or all of LEDs 153 in rail 107.

In some embodiments of the invention, node 110 can provide direct electrical power and/or operational control to a portion of the LEDs in rail 105. Second node 111 can provide direct electrical power and/or operational control to the remaining portion of the LEDs in rail 105. In other embodiments, one node may control the operation of all the LEDs in a rail.

In some embodiments, a rail may have a terminal end that is not coupled with a second node. Rail 106, for example, may not be coupled with a second node. In such an embodiment, all the LEDs in rail 106 can be controlled by node 110. Rail 106 can be fitted with a special or modified end cap.

Node 110 and second node 111 can be communicatively coupled together through communication channel 140 of rail 105. That is, node 110 can communicate with second node 111 using communication modules 125 and 126. For example, node 110 can communicate its unique address or operational information. Second node 111 can also be communicatively coupled with another node through rail 107.

Power can be shared between nodes through power channels (e.g., power channels 145 and 146) within rails 105, 106, and 107. In some embodiments, the power supply in a single node (e.g., node 110) is coupled with a standard AC electrical outlet. This power supply can convert AC power to DC power and provide DC power to the rails connected with the node as well as other nodes connected with the rails. In some embodiments, AC power can be provided to other nodes through the connected rails and DC power to LEDs in connected rails.

In some embodiments, a node may house any needed number of modules (e.g., controller 115, power supply 120, etc.) to supply conditioned and/or controllable electrical power to the LEDs as well as any LEDs on the node associated with egress, night light and indicator functions. The node may also contain control circuitry to collect and interpret sensing data and apply the appropriate responses (e.g., increase LED current over time to counteract lumen depreciation, dim LEDs in response to daylight, on and off switching or dimming based on aisle occupancy, signaling of operational status, etc.). In one embodiment, all node electronics can be designed to match the long life of the rail LEDs.

In addition to the sensors located at the node, sensing data may also come from the rail (e.g., photo sensors that measure the light output of the rail, temperature sensors that indicate the thermal status of the rail's LEDs). Electrical data related to the operation of the LEDs may also come from within the rail, from another node, or be collected from the node's controller. Sensing data may also come from other nodes through the communication channels of connected rails.

In some embodiments of the invention, the node can include a wireless communication device. That is, communication module 125 can include a wireless radio or Bluetooth device. The node modules (e.g., controller 115) can collect, interpret and act upon control data received wirelessly from a centralized control device or other nodes in the system, or wire carried data received from adjacent nodes in a run. The processor(s) in the node (e.g., controller 115) will also be able to receive and retain operating control parameters (e.g., illuminance set points for daylight harvesting, temperature set points for thermal protection, dimming level for an unoccupied aisle, etc.) communicated by wire or wirelessly. Conversely a node can communicate operational data back to a centralized source via any combination of wire carried and wireless communication.

The node level sensing and intelligence capabilities of the invention have a number of benefits related to the spatial resolution of the nodes within the system. Local measurements of temperature, illuminance, daylight availability, occupancy, etc. can be used to control light output of the rails at a correspondingly local level and thus provide maximum operating efficiency.

One example of highly localized control relates to occupancy sensing in warehousing aisles. If each node is equipped with occupancy sensing then detection of aisle activity has a high spatial resolution. If desired, this may allow for implementing a control scheme whereby only the section of an aisle currently being occupied would have rails switched to full light output. To soften the subsequent transition, adjacent rails could step down in brightness with distance from the location of the occupant. As an occupant moved, further into the aisle, the section of lit rail would essentially follow, thus maximizing energy savings by providing light only where and when needed. In another example, node level occupancy sensing could also be used to provide detection redundancy to improve the accuracy of detection and even help predict the direction and speed of the occupant. For example, this could help the system respond more precisely to a fast moving fork truck.

Daylighting provides yet another example of the potential benefits of node level intelligence and the spatial resolution it may afford. Sections of an aisle that are nearer or, further from a skylight can be dimmed to different levels to maintain desired light levels while maximizing energy savings.

A potential application of the networked intelligence of the invention is the possibility for auto commissioning of the system. Every node in an installation (which will generally consist of many separate end-to-end runs) may have a unique and addressable ID. Once installed and powered, adjacent nodes can positively recognize each other as neighbors via the hardwire communication path running through their adjoining rail. This can allow all nodes within a run to know the ID and relative spatial relationship of all other nodes in that run. Secondarily, the wireless communication capability of nodes (whether on every node or one or two primary nodes per run) could utilize a form of triangulation based on relative signal strength to provide the information necessary to ascertain the relative positioning of individual runs. The redundancy of data provided by multiple nodes in a single run at known relative locations can be used to improve the accuracy of this process.

A spatially aware and addressable lighting system can be used to collect data from and broadcast settings to the system on a node by node basis or any kind of zone based configuration. An example usage of such a system might be to signal a forklift operator regarding the location of an item to be picked from the racks via luminance or illumination.

Figure 5:
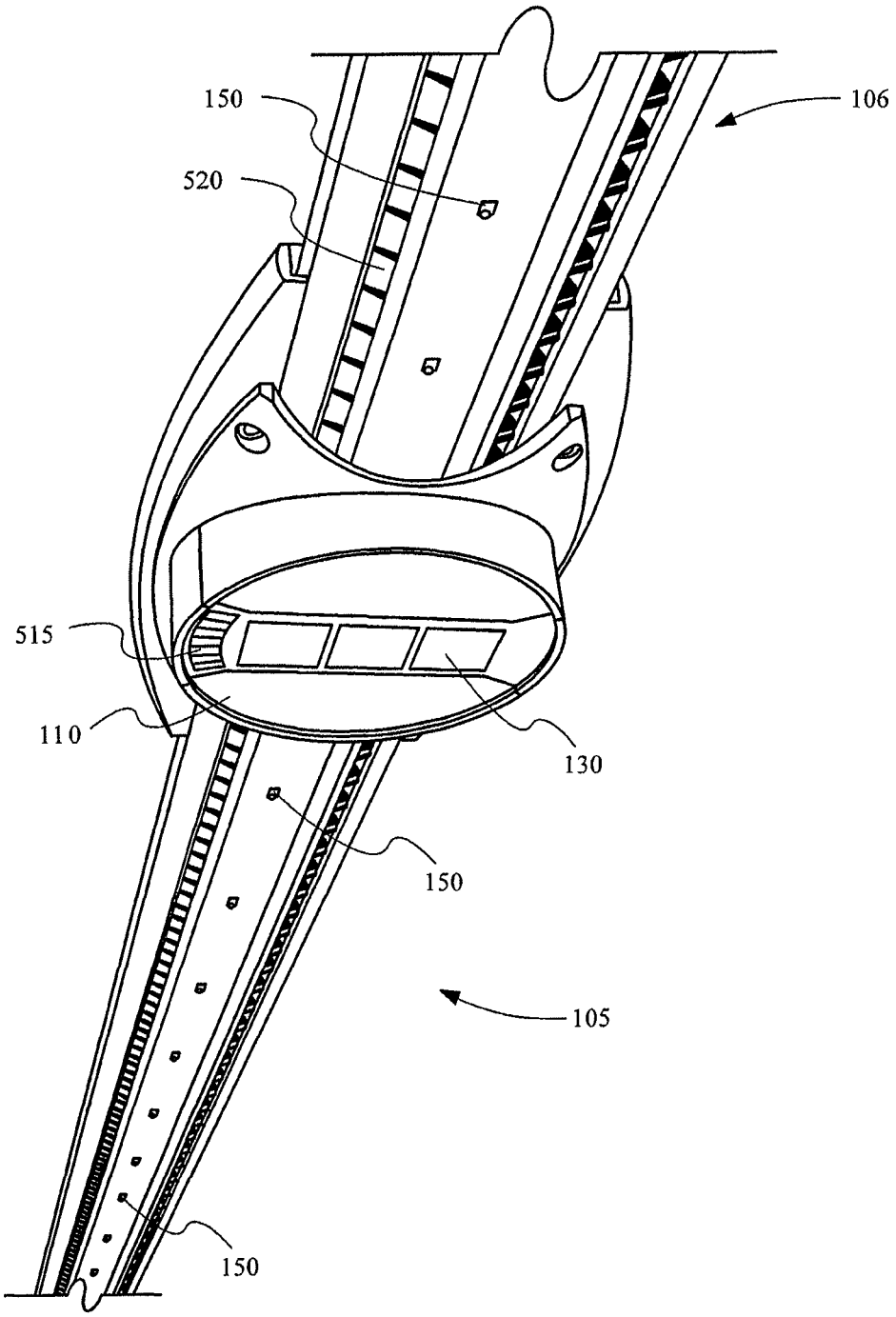
FIG. 5 is a perspective view of a node coupled with two rails according to some embodiments of the invention.

FIG. 5 shows an embodiment of a rail and node assembly that includes a node 110 coupled with rail 105 and rail 106. Various embodiments of the node, the rail, and their assembly are discussed in more detail below.

In alternative embodiments of the invention, rail 105 can be directly coupled with rail 106. The modules associated with node 110 can be absorbed into one of the rails. For example, rail 105 can include a controller and a power supply. Rail 105 can provide power to rail 106 and can provide control to rail 106. As another example, either or both rails can include a power supply, a controller, sensors, a communication module, etc. Communication channels and/or power channels can extend the length of the rails to provide power and/or communication to other rails. Various other configurations can be used.

While rails and nodes are generally shown herein to be coupled together in such a way that they can easily be decoupled; in some embodiments, a node can be conjoined with one or more rails in such a way that they cannot be easily decoupled or disjoined.

Furthermore, in some embodiments, the components described above that are disposed within a node (e.g., power supply, controller, egress lighting, night lighting, sensors etc.) can also be housed in one or more rail. In such a configuration, the rail can generally be considered to control not only the function of the light elements within the rail but also the light elements in other rails.

Embodiments of the Nodes

As described above, a node, according to some embodiments of the invention, can provide a distributed operational and control intelligence to the system that can also work in conjunction with any centralized control devices.

An embodiment of a node 110 is shown in FIG. 5. Node 110 can include some or all of the modules shown in the block diagram shown in FIG. 1.

Node 110 includes central body 555. As shown in FIGS. 5 and 6, according to some embodiments of the invention central body 555 of node 110 is generally cylindrical. This can provide an intuitive cue of its use as a connecting joint and also its differentiated role within the two-component system. This general shape can accommodate top mounting and wiring via a traditional cylindrical (or octagonal) junction box. The central body 555 of the node 110 can be other shapes, however. By way only of another example, the central body 555 may also be a vertically extruded oval with its long dimension aligned with the adjoining rails. This variation may allow space for the node's internal components without disrupting the overall linearity of the system. Various other sizes and shapes of node 110 can be used.

The central body 555 can be conceptually divided into an upper section 650, lower section 660, and middle section 655. Upper section 650 can accommodate features associated with the space above the lighting system, such as building electrical system attachment, physical mounting, uplighting, and/or upward viewing photosensors. Lower section 660 can accommodate features that relate to the space below the system, such as emergency and night light lighting, downward viewing photo and/or occupancy sensors, and indicator LEDs associated with system status and diagnostics. Middle section 655 includes one or more rail receiving port(s) 665 that receive one or more rails. Rail receiving port(s) can include alignment arms 670 to facilitate alignment of rails 105 with the rail receiving ports 665.

As shown in FIG. 5, lower section 660 of node 110 includes bottom face 560 that can house the input apertures for sensors and/or lighting 130 (e.g., occupancy sensor, CCD camera, photo sensors, etc.). These can include occupancy sensor 130, photo sensor 506, and/or egress and/or night light 505. Other sensors may include a CCD camera, smoke sensor, chemical sensor, etc. Egress and/or night light 505, for example, can have the same light source (e.g., LED) or different light sources, but use the same optical element. Egress lighting and/or night lighting 505 can be used to direct people toward exits, for example, in an emergency. Egress lighting 505 can be coupled with battery back up and may include one or more LEDs. Night light 505 can provide a small amount of light for baseline visibility that does not require the full lighting of LEDs within rails 105, 106.

The bottom face 560, further allows for the mounting of LED indicator lights 515 that can signal the operational status of the system (e.g., power on, occupancy sensor triggered, rail dimmed for daylight harvesting or thermal protection, electrical power and communication connectivity, maintenance required, etc.). In one embodiment, indicator lights 515 can be recessed into the bottom face 560 to protect them as well as to shield them from normal viewing angles—in this way they are generally only noticeable when viewed from directly beneath.

The bottom face 560 of node 110, for example, can include an emergency egress light and/or night light 505. The amount of light needed to provide either of these functions may be minimal over the relatively short distance from node to node and can therefore be provided by a single LED (or a few LEDs) with collimating optics inside node 110. For aisle applications, a rectangular or oval pattern of light can be produced to align with the direction of the aisle. For other applications, a symmetric pattern could be used or an asymmetric pattern could be made rotatable to define a specific path of egress. A night light and egress function could potentially be provided by the same aperture on the node or even use a common optic with two separate LEDs and power circuits.

The upper section 650 of node 110 can serve as a mounting point to a building structure and/or can also be a potential feed point for power from the building's electrical system. While each node may or may not utilize or include such functionality, it may optionally be included in each node. The upper section 650 of node 110, for example, may include an upward viewing photo-sensor for use in daylight harvesting in the presence of a skylight system. Furthermore, the node may be configured to provide an uplight component to the photometric output of the lighting system.

Embodiments of the Rails

Rails can generally include the electrical channels and LEDs discussed above. Rails can also work in conjunction and/or couple with nodes as described below. In general, a rail can include many components including, for example, mechanical and electrical connectors for coupling the rail with a node, LEDs or other light sources, optical elements that control the light output, a power channel(s) that conducts power to the LEDs and/or through to another node, a communication channel(s) for inter-node communication, heat dissipation components for thermal control, and/or connectors for coupling the rail with a structure. The primary function of the rail is the actual light output of the system—LED light sources and optical system. It also provides for the thermal management of the LEDs. Furthermore, the rail can supply through-wiring to connect one node to the next both in terms of line voltage power and control signaling. The rail is comprised of three main subsystems—these are the optical module, the thermal management system, and the remaining mechanical and electrical functionality served by the outer extrusions and end caps.

Figure 16A:
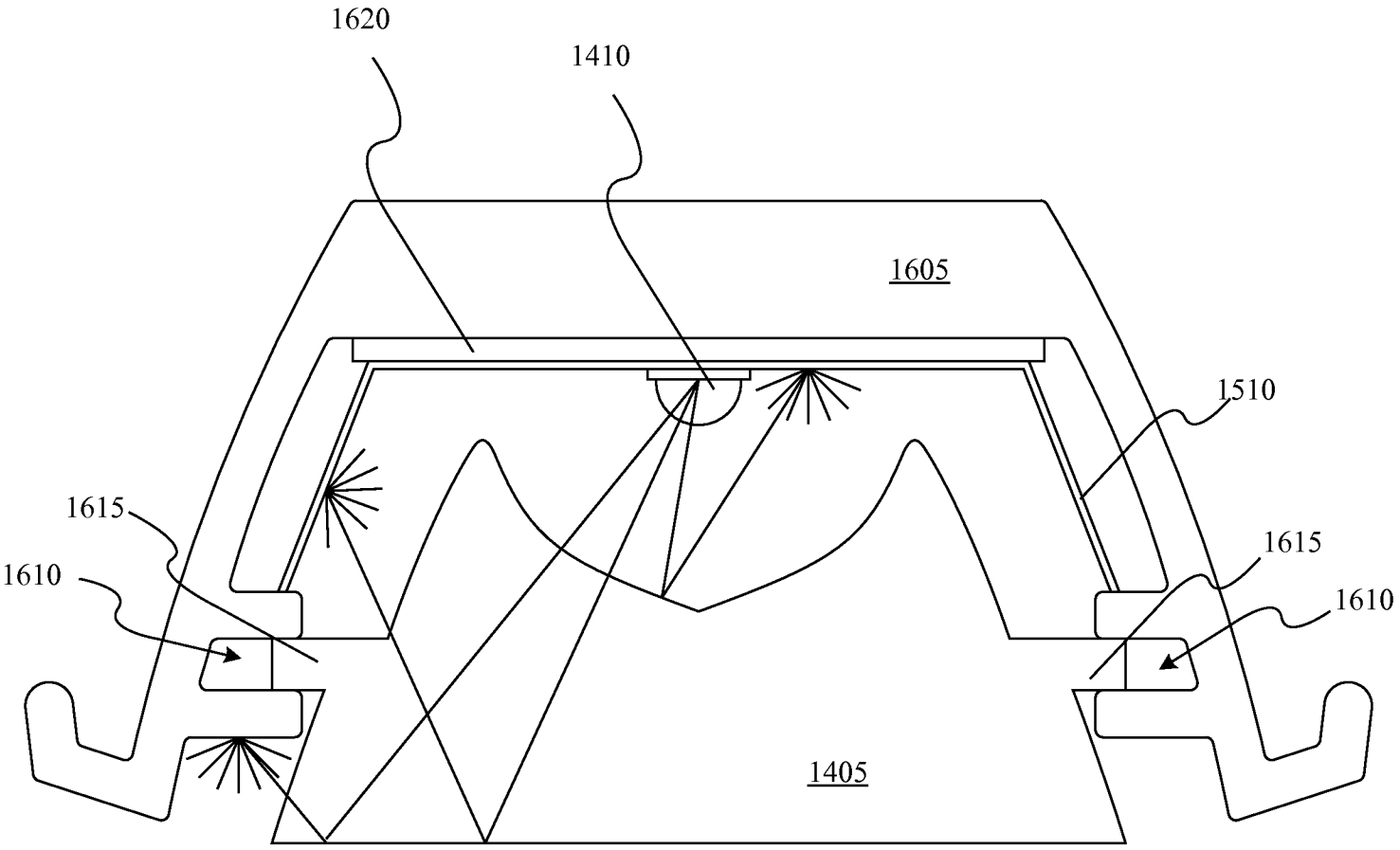
FIGS. 16A & 16B are cross sections of an inner rail housing coupled with a lens, LED and circuit board according to some embodiments of the invention.
Figure 19:
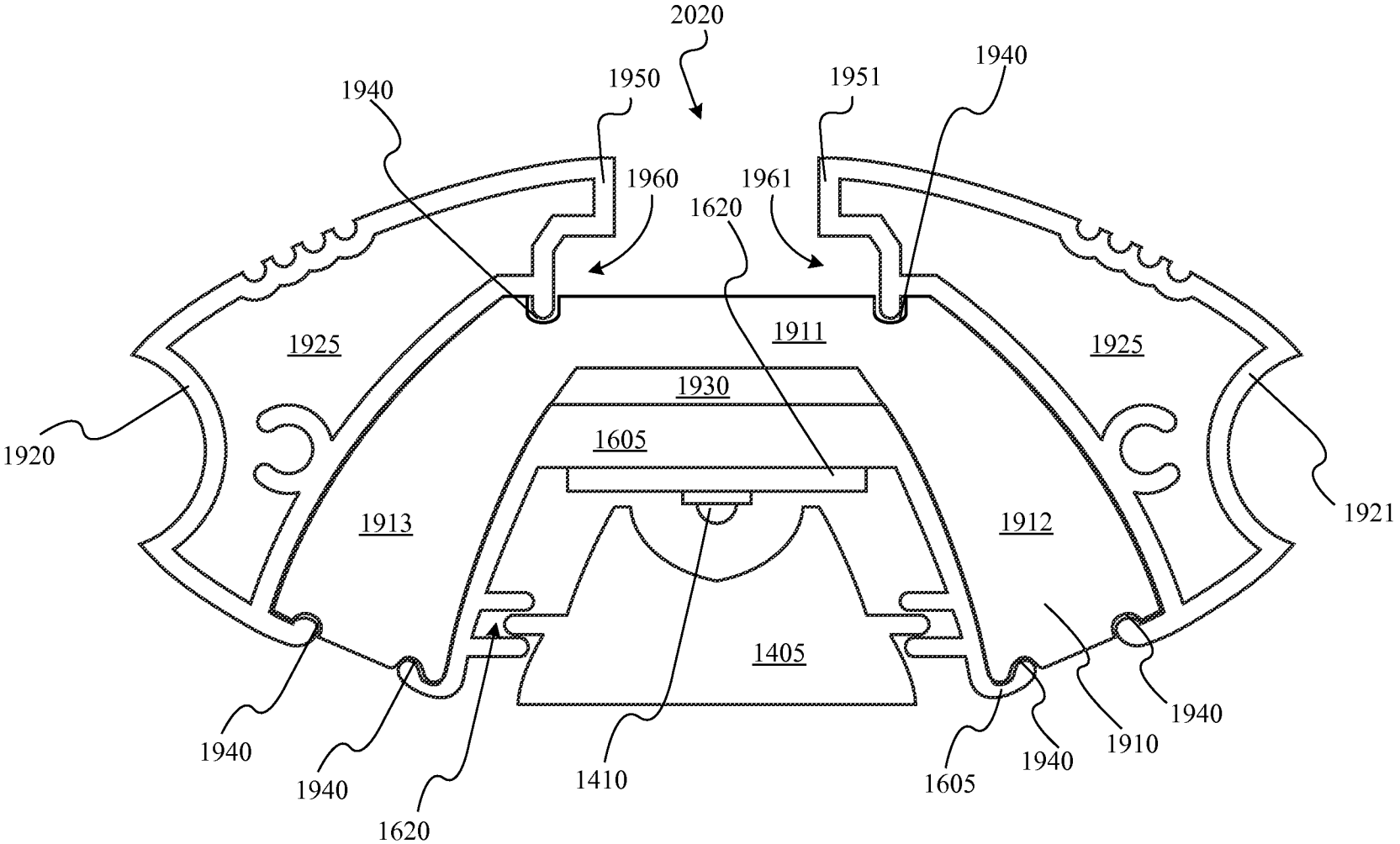
FIG. 19 is a cross section view of a rail with a lens, LED, inner rail housing, outer rail housings, and heat sink according to some embodiments of the invention.

The rails generally include a rail body 645 and end caps 605. FIG. 19 shows a cross-section on an embodiment of a rail body 645. The rail body 645 extends along a rail axis (e.g., axis 2130 shown in FIG. 21B) and includes generally (1) an optical module that includes (i) a lens 1405 and (ii) a inner rail body 1605 which retains lens 1405 and on which the LED circuit boards can be mounted (e.g., circuit board 1620 shown in FIGS. 16A and 19); (2) a heat sink formed by heat sink fins 1910; (3) outer rail housings 1920, 1921 and (4) end caps 605. Each is discussed below.

The optical module includes inner rail body 1605. Inner rail body 1605 can be an extruded member that extends nearly the entire length of the rail. Inner rail body 1605 can provide structural support and mounting for one or more linear circuit boards 1620 that have been populated with LEDs 1410. These LEDs can be disposed along the length of the optical module in a linear fashion and separated by a distance. Inner rail body 1605 can provide a thermally conductive path for heat generated by the LEDs toward heat sink fins 1910 (shown, for example, in FIG. 19). Circuit boards 1620 can be mounted in a near end-to-end fashion with some means to transfer DC power between adjacent boards. Circuit boards 1620 can have individual lengths that can be dictated by engineering, manufacturing, and economic factors, but can be sized to uniformly fill nearly the entire length of the inner rail body 1605 with a linear array of LEDs 1410.

Figure 16B:
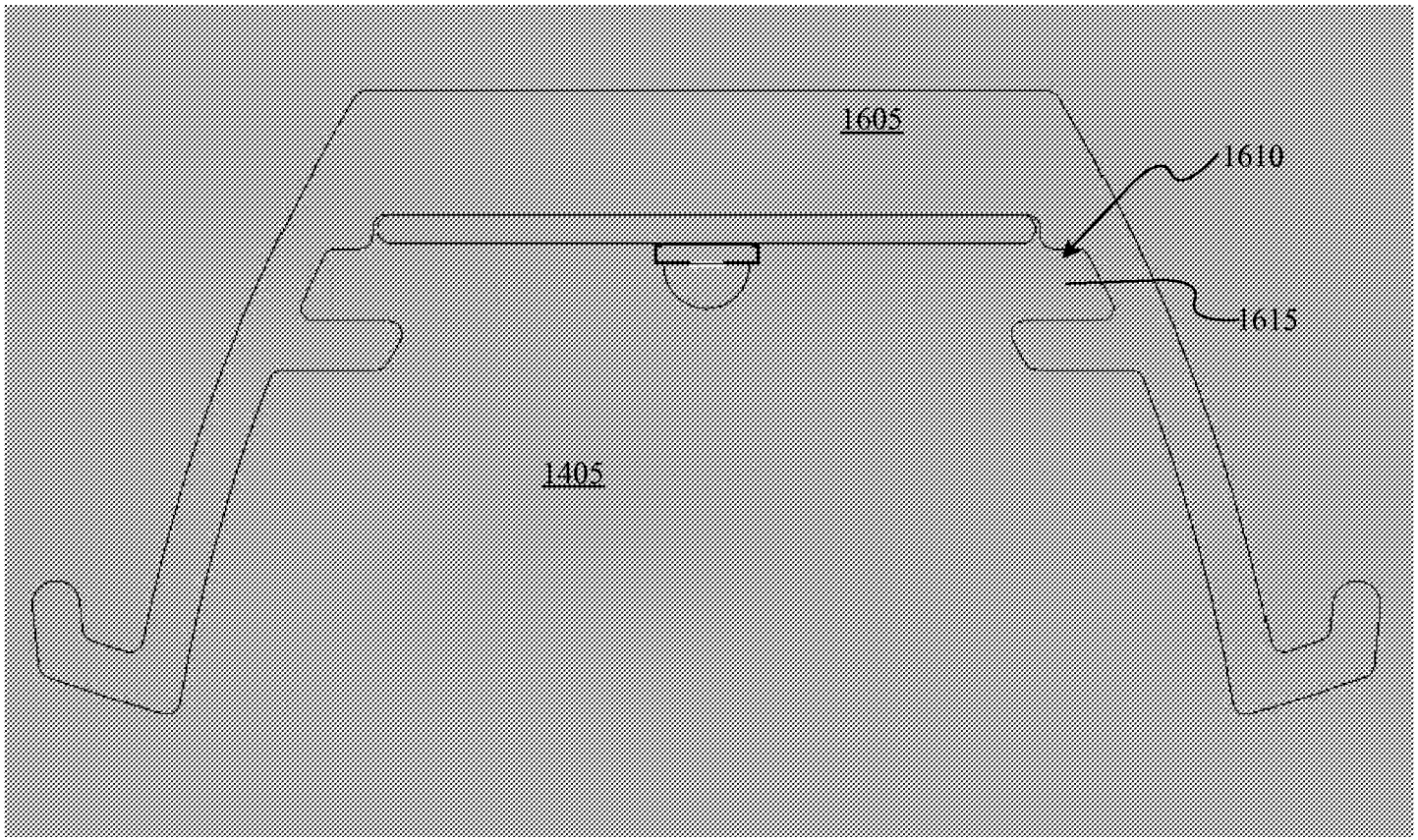
Figure 23A:
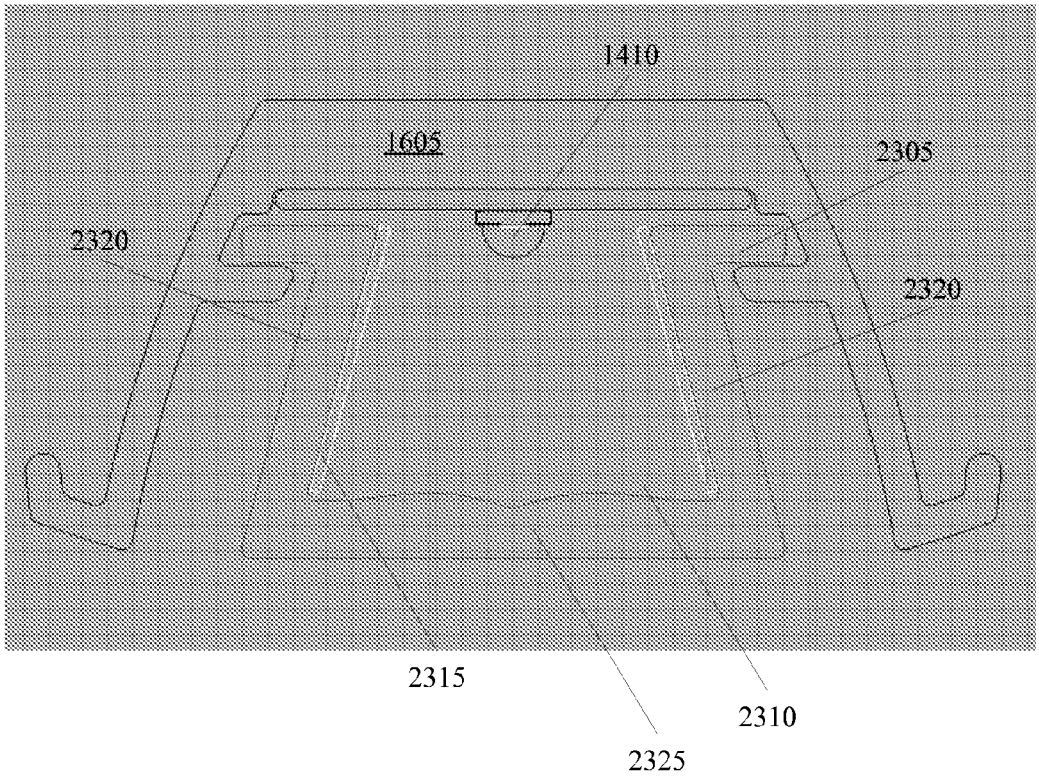
FIGS. 23A and 23B are cross sections of lenses that can be used in embodiments of the invention.

The inner rail body 1605 is designed to retain a lens 1405. Any method (mechanical or chemical) for coupling the inner rail body 1605 and the lens 1405 is contemplated herein. In one embodiment, inner rail body 1605 can include mounting channels 1610 that receive mounting tabs 1615 on lens 1405. Mounting channels 1610 and mounting tabs 1615 can ensure the proper optical alignment of lens 1405 with respect to LEDs 1410 as well as effectively remove any twist or camber that a long lens part may have. The mounting channels 1610 and/or mounting tabs 1615 can be positioned anywhere on or within lens 1405 and/or inner rail body 1605 as shown in FIGS. 16B, 19 and FIG. 23A. As discussed in more detail below, various configurations of lenses 1405 are contemplated. The lens 1405 can extend along any portion of the rail 105 but in many embodiments it will be preferable that the lens or a collection of lenses extend along the entire length of the rail 105.

The primary function of lens 1405 is to tailor the light output pattern of LEDs 1410 into the desired photometric distribution for the lighting system. Lens 1405 serves the secondary purpose of protecting LEDs 1410 and sealing the optical module. The desired photometric distribution and resulting lighting effect is dependent on the type of application and the specific geometry, and thus the optical properties of the lens 1405 may be tailored to suit the photometric needs of particular applications.

One such application is lighting along an aisle within a store. In such applications, it can be beneficial to provide more light on the shelves than along the aisle. Embodiments of the invention can provide an aisle-wise photometric distribution that illuminates shelves uniformly.

Figure 11:
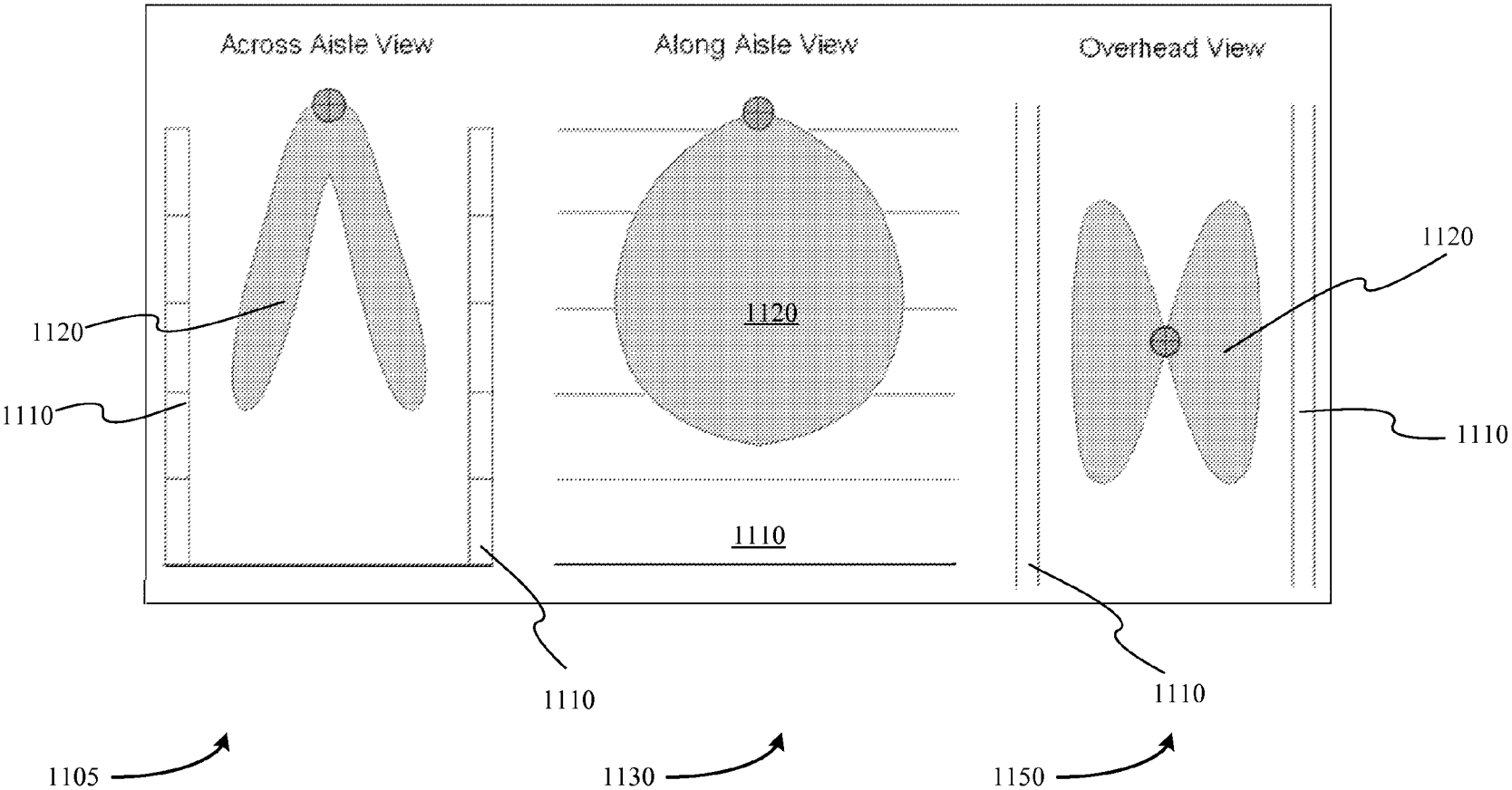
FIG. 11 is a graph of an example of a photometric distribution of a light source in an aisle lighting application from three perspectives according to some embodiments of the invention.

FIG. 11 is a polar plot of luminous intensity as a function of angle for an aisle lighting application from three cardinal views according to some embodiments of the invention. Rail 105 can include the proper optical components to provide such luminous intensity. A mono point light source is assumed in these depictions indicating the photometric distribution of any small portion of the rail. 1105 shows an across aisle view; shelves 1110 are shown along both sides of the aisle. Luminous intensity distribution 1105 is a configuration with the majority of the light directed toward shelves 1110.

View 1130 shows an along aisle view of photometric distribution 1120. The light is generally evenly spread along the length of shelves 1110. A small batwing shape may be allowed. A non-batwing profile may also be used. View 1150 shows the luminous intensity 1120 from an overhead perspective. This view shows the light being punched toward shelves 1110 in a roughly continuous fashion along the length of shelves 1110.

The vertical punch (i.e., photometric articulation) in view 1105 counteracts the natural tendency to produce lower light levels on the bottom portion of the rack relative to the top. Lower portions are more distant and the angle of incidence is more grazing. This can be compensated for by concentrating more light near the bottom of the rack. Likewise, the lateral punch shown in view 1150 illuminates points located between adjacent luminaires along the aisle. The gap in the distribution along the aisle way in view 1150 illustrates how light is restricted in that zone for the purpose of controlling glare along the aisle, whereas the gap in the distribution directly below the fixture in view 1105 serves the same purpose for when the luminaire is viewed from underneath.

Figure 12:
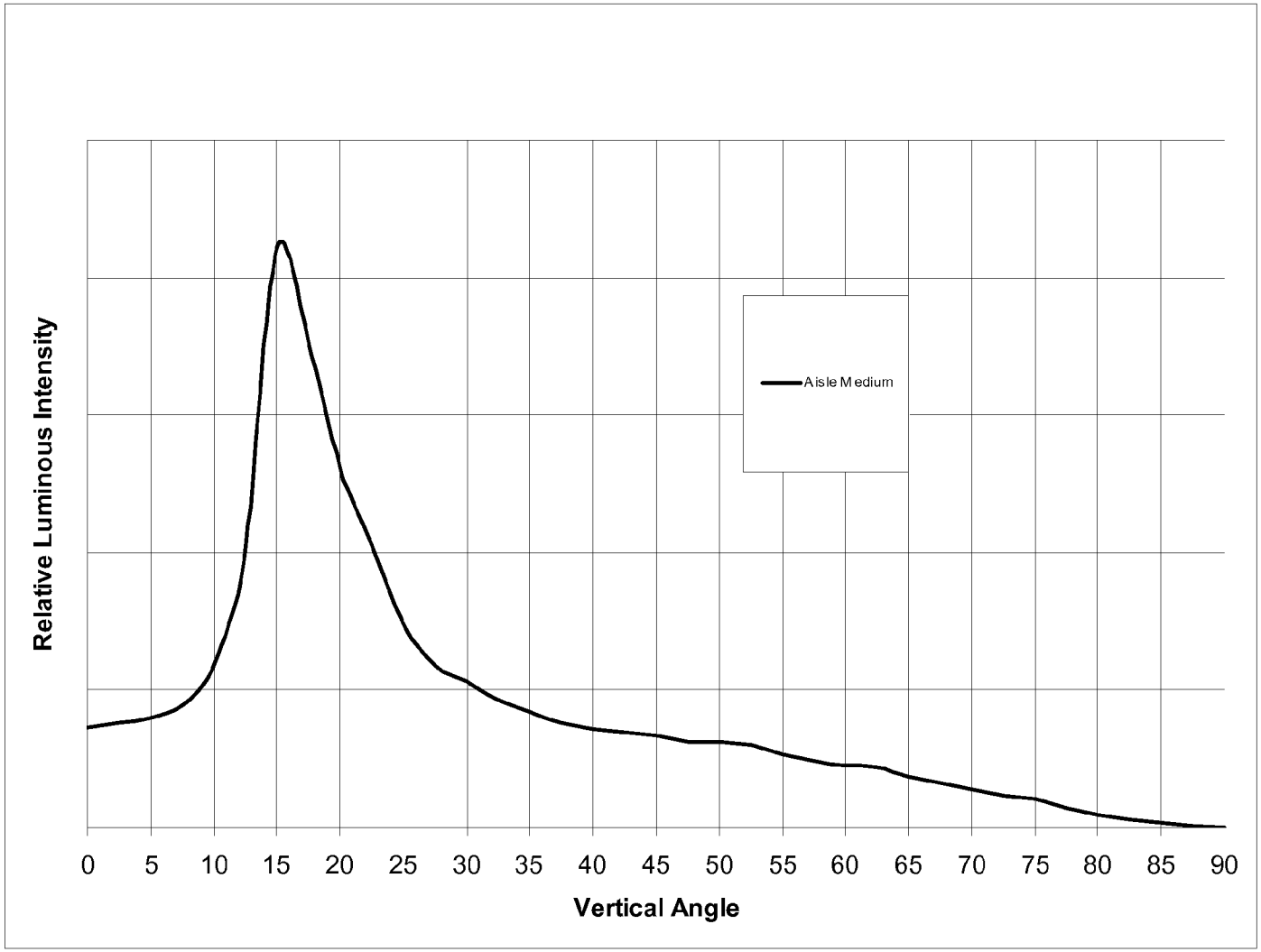
FIG. 12 is a graph showing the relative intensity as a function of vertical angle across the aisle for an aisle application according to some embodiments of the invention.

FIG. 12 is a graph showing the relative intensity of light exiting the exit surface of a lens that can be used within rail 105 as a function of vertical angle in the across aisle dimension according to some embodiments of the invention. As shown in the figure, the peak intensity is found 15° from nadir. This peak intensity may also be any value within 10° to 20° depending on the width of the aisle, the height of the shelves, the location of the lighting fixture within the aisle, the height of the light fixture, etc. This relative intensity profile shows how the light is directed to illuminate the shelving instead of the aisle. In some embodiments, the peak intensity can be as low as 7° in some embodiments and as high as 30° in others. In other embodiments, the intensity of light drops off precipitously below 15° and is insignificant below 10°. In some embodiments the relative intensity of light that exits the exit surface between 10° and 20° from nadir is more than double the relative intensity of light that exits the exit surface between 0 and 10° and 20° to 90° combined.

Figure 13:
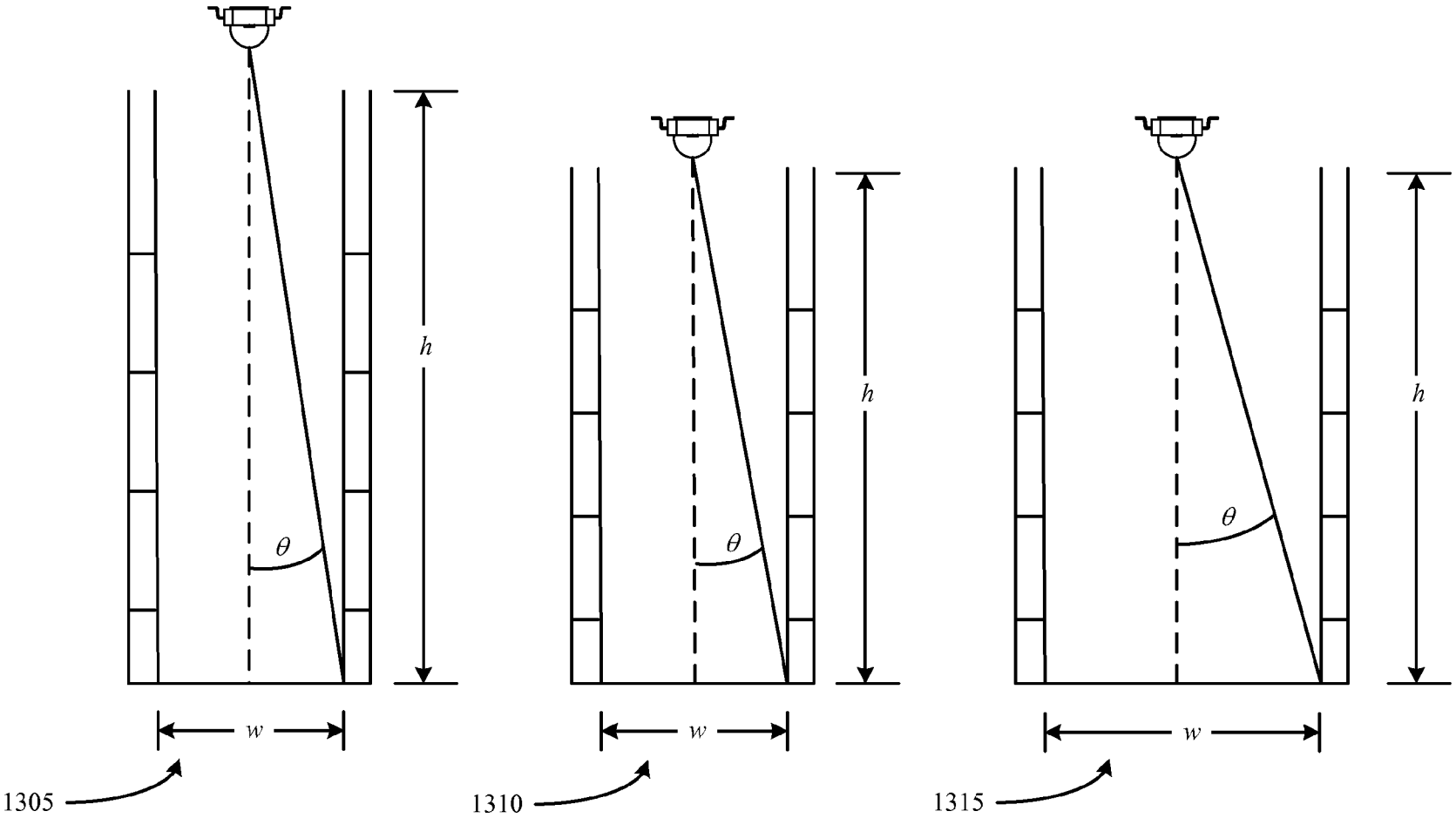
FIG. 13 is a diagram of three aisle configurations with shelves of different heights, light source positioned at a different height, and aisles of different widths.

FIG. 13 shows three aisle configurations with shelves of different heights, light sources positioned at different heights, and aisles of different widths. The light sources shown are representative only and are not drawn to scale. The light sources may be considered point sources. These figures show how the angle of the peak intensity, θ, may vary based on the height of the light source and/or width of the aisle. The LEDs shown in the three configurations are examples only and are not drawn to scale. Moreover, while an LED is shown, any type of light source and/or optics can be used like a rail described in various embodiments herein. Configuration 1305 has an aisle width, w, of eight feet, a shelf height, h, of thirty feet, and a light source height above thirty feet. In this configuration, the angle of peak intensity, θ, can be 7°. Configuration 1310 has an aisle width, w, of eight feet, a shelf height, h, of twenty feet, and a light source height above twenty feet. In this configuration, the angle of peak intensity, θ, can be 10°. Configuration 1315 has an aisle width, w, of twelve feet, a shelf height, h, of twenty feet, and a light source height above twenty feet. In this configuration, the angle of peak intensity, θ, can be about 15°. Various other angles may be used depending on the configuration of shelving width, shelving height, and/or light source placement.

Figure 14:
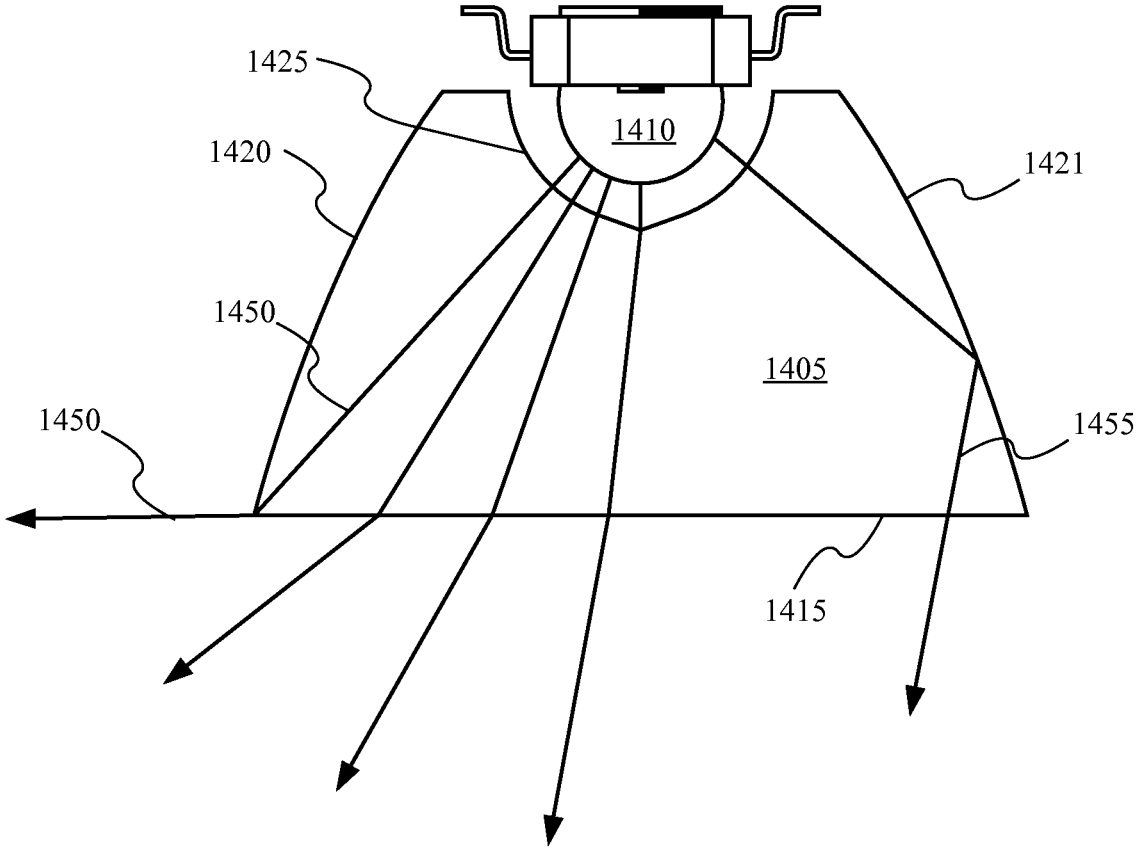
FIG. 14 is a cross section of a lens that can be used in a rail according to some embodiments of the invention.

FIG. 14 is a cross section of LED 1410 and lens 1405 that can be used within a rail 105 that produces lighting effects described in conjunction with FIGS. 11-13 according to some embodiments of the invention. LED 1410 shown in FIGS. 14-16 can be any type of light source. LEDs 1410 are not drawn to scale and may come in any package or configuration. A number of light rays are shown. While LED 1410 is shown any type of light source may be used. Lens 1405 can be an elongated member having the cross sectional shape shown in FIG. 14, a similar shape, or provide the same photometric distribution.

Figure 15A:
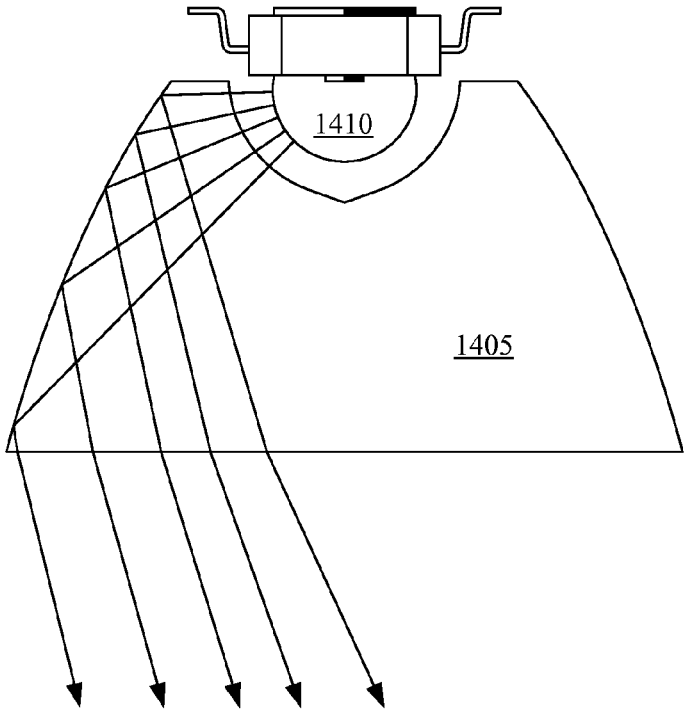
FIG. 15A and FIG. 15B show the light rays traced from an LED through a lens according to some embodiments.
Figure 15B:
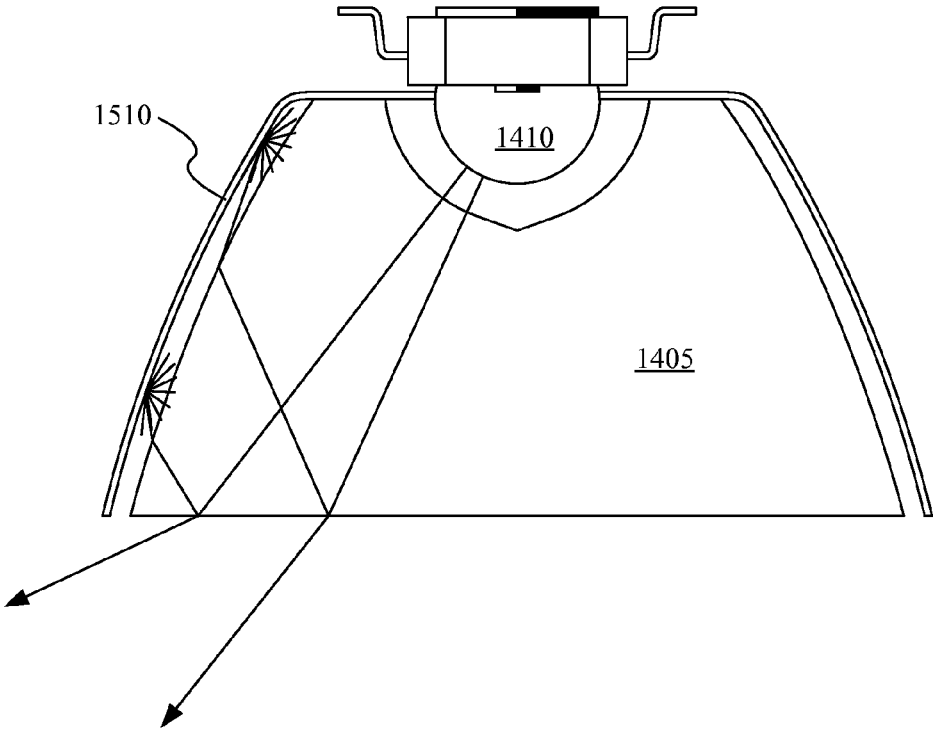

Light from LED 1410 enters lens 1405 through entrance surface 1425 and exits through exit surface 1415. In some embodiments, light may be reflected off of side surfaces 1420 and 1421 via total internal reflection. In other embodiments, side surfaces 1420 and 1421 may include a reflective coating as shown in FIG. 15A. Or side surfaces 1420 and 1421 may disposed or housed near reflective surface 1510 as shown in FIG. 15B. Light reflected from reflective surface 1510 can be scattered back through lens 1405 and may exit through exit surface 1415. Lens 1405 can be an optically clear material. In some embodiments, lens 1405 can be extruded from a single piece of material.

FIG. 15B also shows that light rejected by Fresnel reflection at the exit face ends up illuminating this highly reflective material that surrounds the lens. There, it gets reflected back into the optic and ultimately emerges through the exit face in a more or less Lambertian distribution. This can improve the overall system efficiency.

Lens 1405 can comprise an elongated lens having the cross section shown in FIG. 14. That is, the lens can extend along a length extending into the page. Exit surface 1415 can be substantially flat and extend the length of lens 1405. The length of the lens can be ten times longer than the width of exit surface 1415 and/or the width of entrance surface 1425. The length of lens 1405 can also be twenty times the width of the lens.

Entrance surface 1425 in FIG. 14 can be a U-shaped or V-shaped cusp. This shape can help direct light away from nadir to help achieve the photometric distribution discussed. This can be desirable for glare control and/or shelving lighting.

In some embodiments, left most ray 1450 can strike the edge of exit surface 1415 at an incident angle at or near to the critical angle of lens 1405. As shown in the figure, left most ray 1450 is incident on exit surface 1415 at an angle near the critical angle and is refracted essentially parallel to exit surface 1415. This feature can provide smooth illumination on a nearby vertical structure all the way up to the height of the lens.

In some embodiments, side surfaces 1420 can act as a TIR (Total Internal Reflection) based reflector. For example, light 1455 may be reflected from side surface 1421 at an angle greater than the critical angle measured from the surface normal and leave exit surface 1415 at a shallow angle. This high angle light may be directed, for example, toward the bottom portions of an adjacent rack where even illuminance can be difficult to achieve due to distance from the luminaire and the grazing angle of incidence. These TIR contours (as with the other surfaces of the lens) may be smooth continuous curves or may be facetted.

The lens 1405 may be a thin walled lens 2305, as shown in FIG. 23A. Additional optical elements 2310 (e.g., a ribbed disperser, a diffuser, a filter, a focusing lens, etc) can be placed within lens 2305 on horizontal member 2325. Diffuse reflector 2315 can also be placed within lens 2305 near wall members 2320. Horizontal member 2325 can include a substantially flat bottom surface and/or an internal surface having a curved shape that is symmetrical about the elongated axis of the lens. Horizontal member 2325 can be thinner along a center axis of the horizontal member than other portions of the horizontal member. In some embodiments, the thin walled lens can be extruded from a single material such that wall members 2320 and horizontal member 2325 are extruded from the same material.

Figure 23B:
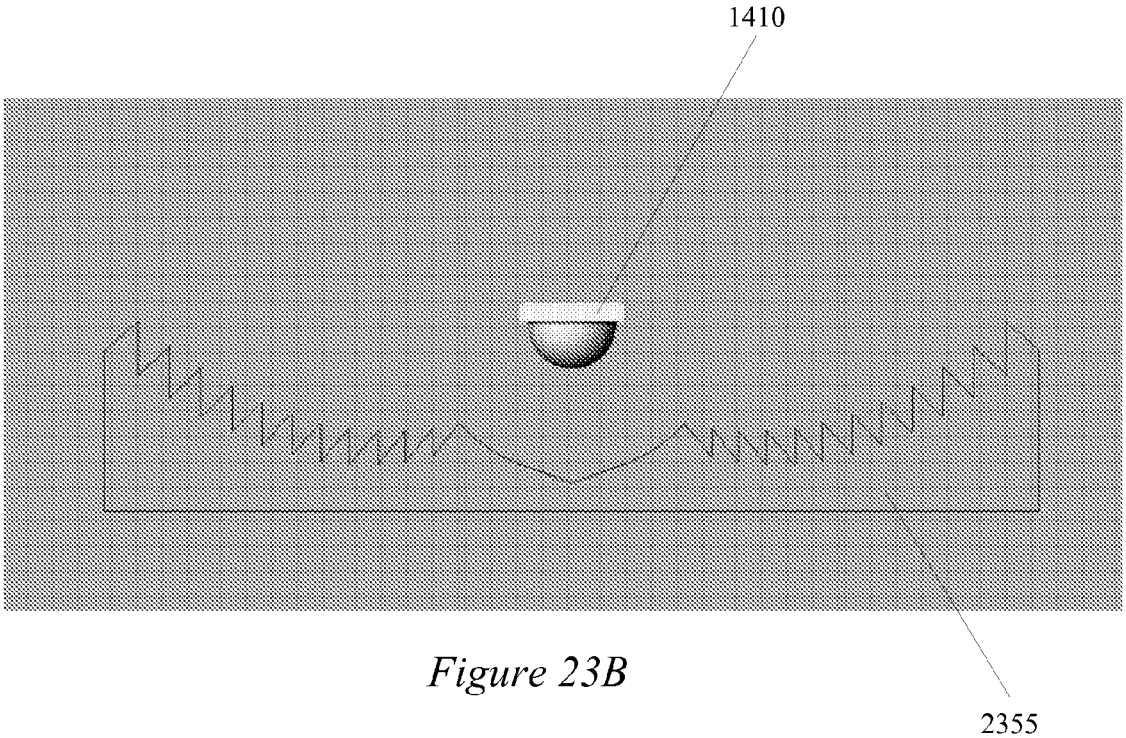

FIG. 23B shows another example of an alternative lens 2355 that can be used to provide the photometric distribution described herein. This lens can use Fresnel and/or total-internal-reflection to produce the desired photometric distribution. A Fresnel lens can include a plurality of elongated prisms as part of or on the interior surface of the lens as shown. These elongated prisms can span the length of lens.

In some embodiment of the invention, a lens can work with light sources, such as LEDs, that provide a mostly Lambertian distribution of light (i.e., where the integral lens provides little to no refractive shaping of the light from the base chip).

Figure 17:
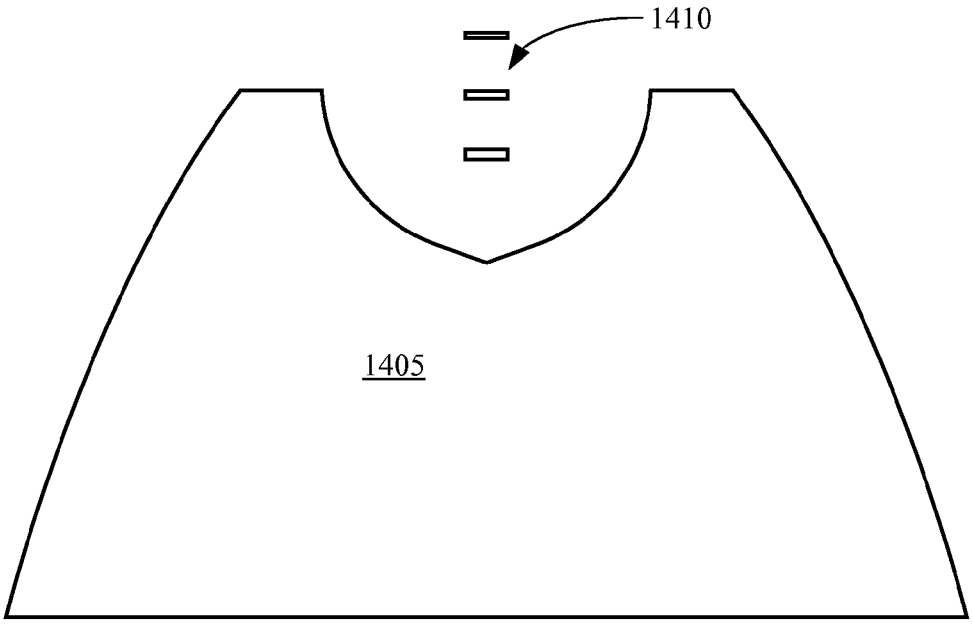
FIG. 17 shows different positions for LEDs relative to a lens according to some embodiments of the invention.
Figure 18:
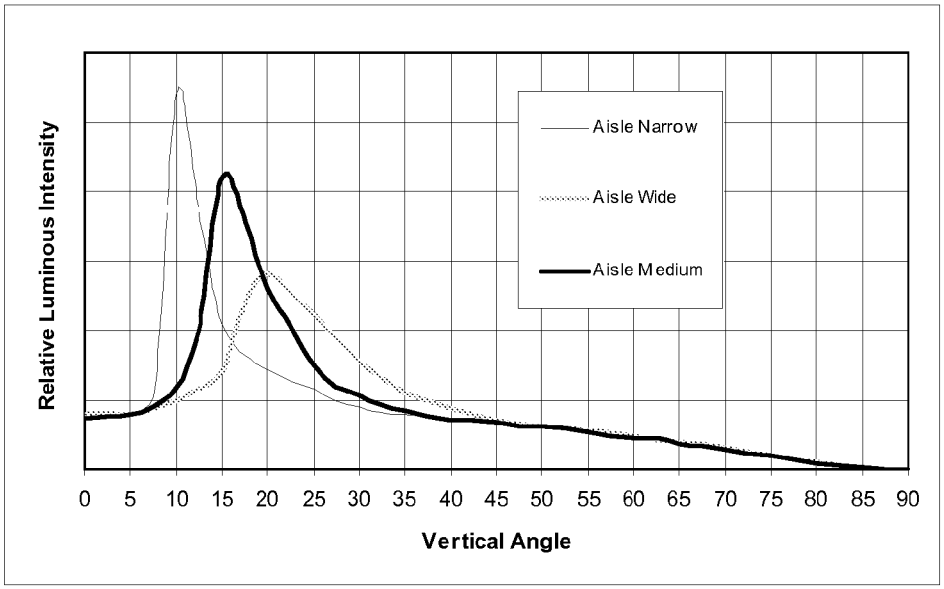
FIG. 18 is a graph showing the effects of LED position on the luminous intensity distribution using embodiments of the invention.

Various combinations of lenses, optical inserts, and/or relative placement of lens 1405 can be used depending on the light shaping to optimize for different application geometry (e.g., luminaire mounting height, rack height, aisle width). FIG. 17 shows the placement of an LED 1410 relative to lens 1405. By varying the back wall thickness of the inner rail body 1605, the LEDs may be positioned closer or, further from the lens and thus as a system can produce narrower or wider distributions of light. FIG. 18 is a graph showing the effects of LED position on the luminous intensity distribution or the use of different lenses. This graph is an example only and various other effects may be seen. This graph shows how the vertical angle of peak intensity varies as the position of the LED varies.

Figure 24:
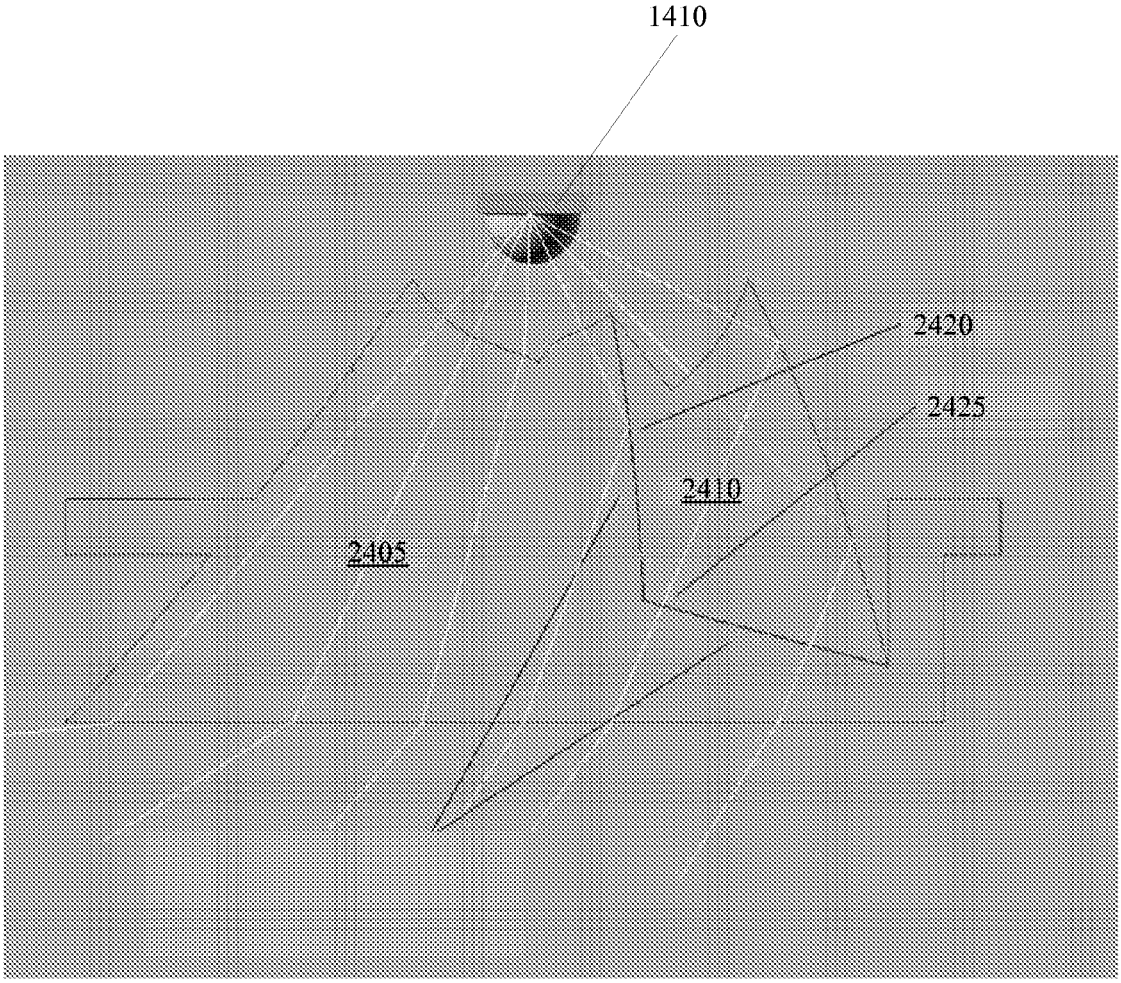
FIG. 24 is a cross section of a dual lens for asymmetric light distribution according to some embodiments of the invention.

Different lens designs can be implemented to suit the photometric needs of different applications. For instance, a lens intended for an open area may place more light directly below the system. Another example involves perimeter racks at the end of aisles where only one side of the aisle has storage racks and thus an asymmetric photometric distribution is ideal. This can be done, for example, by using two separate linear lenses as shown in FIG. 24. In FIG. 24 one smaller lens 2410 nests with larger lens 2405 such that they share two common edges 2420, 2425. At glancing angles light from LED 1410 is reflected at interface 2420. Similarly the back surface of lens 2410 also reflects light at glancing angles. This configuration allows for an asymmetric distribution of light as the majority of light is directed toward one side of lens 2405.

Some embodiments of the invention show exit surface 1415 as a smooth surface. An alternative embodiment may include a structured aperture to help alleviate a multi-edged shadowing effect due to the discreet nature of the individual LEDs. Such a feature may disperse light primarily or exclusively in the long dimension of the lens and might be implemented via molding, co-extrusion, a secondary part, an optically cemented overlay, etc. Such a diffusing element or treatment might also have aesthetic and glare benefits relative to the lit appearance of the system. Minimizing multi-edged shadows can also be aided by using lower lumen output LEDs with a correspondingly closer spacing.

Embodiments of the invention can move light that has been traditionally directed to the floor of the aisle onto the racks. Doing this can have several advantages. As mentioned, it can mitigate the potential for glare in an application where the line of sight to the task is adjacent the light source. It can also result in energy savings by reducing the overall amount of light required. Shifting light from the aisle-way to the racks also serves to highlight and focus attention on the racks and their content via contrast. Making the contents of the racks stand out in this way can be especially valuable for retail applications. It is, further believed that the combination of reduced glare and increased contrast can lead to better visibility than would be predicted by conventional metrics. This effect can be used to either create a more productive and appealing lit environment or save additional energy by permitting reduced light levels, or some combination of both.

In addition to photometric performance LEDs can offer a host of advantages for achieving other forms of operational optimization. These include lower maintenance requirements (e.g., long life and physical robustness) and the significant energy-savings potential of applying controls to this application (e.g., occupancy sensing and daylight harvesting). These operational benefits take advantage of the inherent characteristics of LEDs and are well-aligned with ongoing market trends. While fluorescent lamps offer similar operational flexibility, it comes at the price of reduced efficacy and shortened lamp life. As important, the size of tube fluorescents inherently limits optical control and product size (e.g., T2 lamps could be made to fit, but still would not provide the optical control, efficacy or other operational benefits of LEDs).

While LEDs are advantageous; they generate heat that can be detrimental to their performance and operational life. The linear architecture of some embodiments of the invention provides for LEDs being spread apart from each other producing a less concentrated heat profile. But this may not be sufficient. Hence a heat sink with a plurality of spaced fins can be used to aid in heat dissipation.

Figure 20:
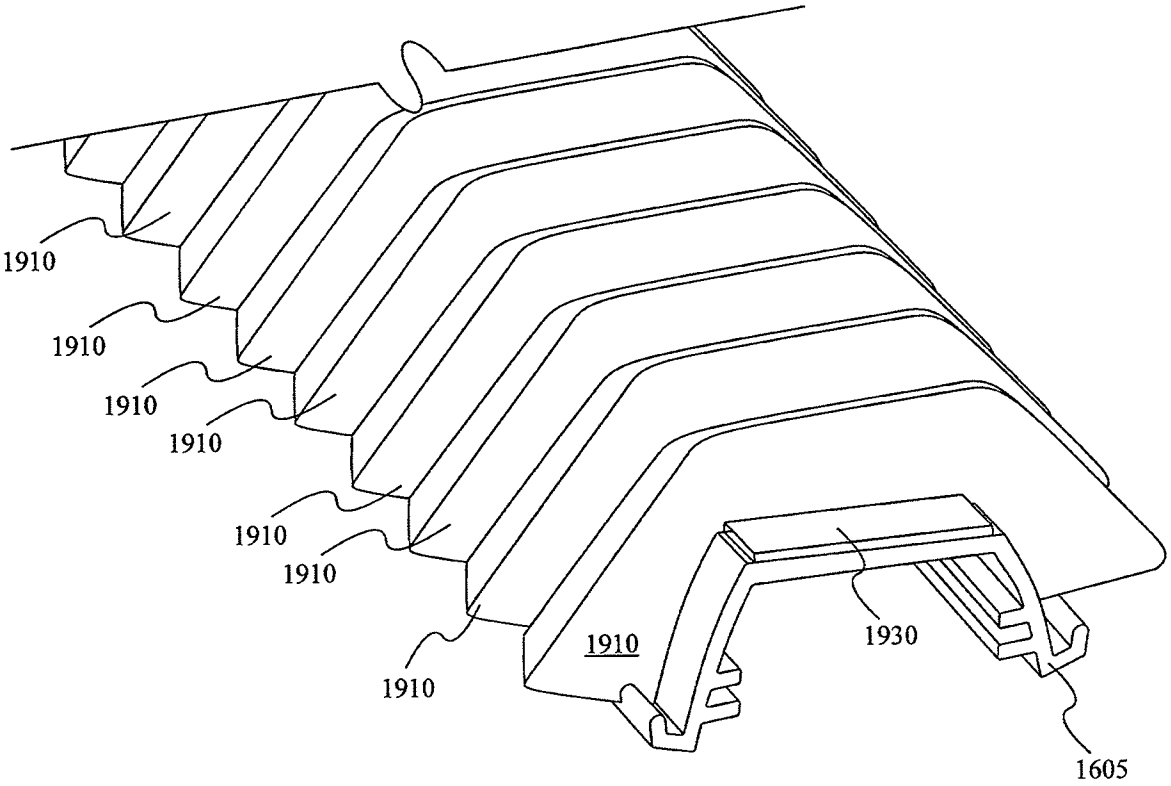
FIG. 20 is a perspective view of a heat sink coupled with an inner rail housing according to some embodiments of the invention.

Circuit board 1620 can include a linear array of LEDs 1410 and can be coupled with inner rail body 1605 as described above. As best seen in FIGS. 19 and 20, in some embodiments a heat sink is provided in the rail for thermal management of the lighting system. The heat sink includes a plurality of heat sink fins 1910, which in some embodiments are positioned along the length of inner rail body 1605 so that a space 520 is formed between adjacent fins 1910. In some embodiments, the heat sink fins extend transverse relative to the rail axis 2130. Heat sink fin 1910 can be coupled with inner rail body 1605. In the disclosed embodiment, the heat sink, further includes an elongated member 1930 that is coupled to, and extends along at least part of the length of, the inner rail body 1605. In this way, the elongated member 1930 extends along an axis that is substantially aligned with the rail axis (e.g., rail axis 2130 in FIG. 21B). The heat sink fins 1910, in turn, are coupled to or otherwise extend from the elongated member 1930.

Heat sink fins 1910 can have a roughly U-shaped configuration. That is, each heat sink fin 1910 can include base 1911 and two arms 1912, 1913 that extend downwardly from base 1911. Each heat sink fin 1910 can be relatively thin and can comprise a metal material such as aluminum. Base 1911 of each heat sink fin 1910 can be coupled with elongated member 1930. Base 1911 can extend above elongated member 1930 and arms 1912, 1913 can extend below elongated member 1930. In some embodiments, heat sink fins 1910 can be corrugated, while in other embodiments heat sink fins 1910 can be flat. In some embodiments, heat sink arms 1912, 1913 may not include base 1911. In such embodiments, heat sink arm 1912 is not connected to heat sink arm 1913. Instead, both fins can be connected only via elongated member 1930. In some embodiments, heat sink fins 1910 can be manufactured with a metal stamping process and/or a casting process. The disclosed embodiment of the heat sink fins 1910 are intended to be illustrative only and are not intended to limit the possible heat sink fin geometries according to embodiments of this invention.

Heat sink fin 1910 can be part of a series of heat sink fins that extend along the length of the rail as shown in FIG. 20. Each heat sink fin 1910 can be coupled with elongated member 1930 that extends the length of the rail and can be coupled and/or in contact with inner rail body 1605.

The rail 105 can also include an outer rail body that at least partially encases the heat sink and inner rail body 1605. While the outer rail body may be a single, integral piece, in the illustrated embodiment the outer rail body is formed by outer rail housings 1920, 1921 positioned around the heat sink fins 1910. The outer rail housings can be formed of extruded aluminum but other suitable materials and manufacturing methods are certainly contemplated herein. The outside edges of heat sink fins 1910 can be in thermal contact with outer rail housings 1920, 1921, which can provide additional heat sinking mass and area for heat conduction. Heat sink fins 1910 can include a number of notches 1940 that can be used to mate with details on inner rail body 1605 and outer rail housings 1920, 1921. Heat sink fins 1910 and outer rail housings 1920, 1921 can engage to form a ball and socket like hinge structure. During factory assembly, the outer rail housings 1920, 1921 can be pivoted about these hinges and then snapped into place around the heat sink fins 1910 by engaging the top details on both parts. Thus, in some embodiments, the outer rail housings 1920, 1921 snap-fit on to a heat sink fin 1910. Alternatively, all the mated parts can slide together. In this way, outer rail housings 1920, 1921 can cover the outside edges of heat sink fins 1910.

In the illustrated embodiment, the top inside edges 1950, 1951 of outer rail housings 1920, 1921 form rail channel 2020 along the top of the rail 105. While rail channel 2020 may be formed to have any shape, rail channel 2020 is provided with an undercut 1960, 1961 to impart a substantially T-shape to rail channel 2020, whereby rail channel 2020 is narrower at the top and wider at the bottom. Rail channel 2020 provides an exit aperture for convective air flow. Rail channel 2020 could also be used as a mechanism to provide the rail 105 with an upward component of emitted light if desired, which could be generated by the same LEDs providing the main downward lighting component or by an additional set of LEDs dedicated to uplight.

In this embodiment, outer rail housings 1920, 1921 and inner rail body 1605 are not directly coupled together and are not in contact. Instead outer rail housings 1920, 1921 and inner rail body 1605 are coupled together with heat sink fins 1910 disposed in between. Similarly outer rail housings 1920, 1921 can likewise not be in direct contact but may be coupled individually with heat sink fins 1910. That is, outer rail housing 1921 and inner rail body 1605 may comprise the main structural elements of the rail, but can be separate and distinct elements that are not coupled together.

Circuit board 1620 can have a metal core and/or thermal vias to conduct heat to the back of the board. In some embodiments, circuit board 1620 can be mounted to inner rail body 1605 with thermal interface material (e.g., thermal epoxy and/or a sill pad or the like) to constitute a high efficiency path for excess heat Inner rail body 1605 can be in positive thermal contact with heat sink fins 1910 via elongated member 1930. As shown in FIG. 20, the plurality of heat sink fins 1910 maximizes the surface area of the heat sink for greater heat dissipation. The mechanical combination of inner rail body 1605 and the array of heat sink fins 1910 form a spine-like structure that serves as structural support for the rail in addition to its heat sinking function. Because inner rail body 1605 and outer rail housings 1920, 1921 are not coupled directly together and because heat sink fins are separated from each other, an air channel is formed between adjacent heat sink fins 1910. Air can enter the channel between adjacent heat sink fins 1910 and move upwardly through the channel between heat sink fins 1910 in a direction that is at an angle to the rail axis (e.g., rail axis 2130 shown in FIG. 21B). In some embodiments, the air channels are oriented substantially perpendicular to rail axis 2130. Air within this air channel can be heated by heat sink fins 1910 causing the air to rise and convect through rail channel 2020 formed between outer rail housings 1920, 1921.

As shown in FIG. 20 heat sink fins 1910 can be oriented transverse relative to the elongated rail axis 2130. Heat sink fins 1910 can be oriented perpendicular to the axis of the rail. This orientation may be more conducive to heat extraction by virtue of natural and passive convection.

Passageways 1925 can be formed in outer rail housings 1920, 1921 for the through-wiring of both electrical power (e.g., including a separate emergency circuit if present) and communication signals from one node to the next. Through-wiring can allow an entire long run of nodes and rails to be powered by a single electrical drop from the building's electrical system to a single node located anywhere along the run. For example, the communication channels 140 or the power channels 145 schematically illustrated in FIG. 1 may be run through passageways 1925.

Figure 8:
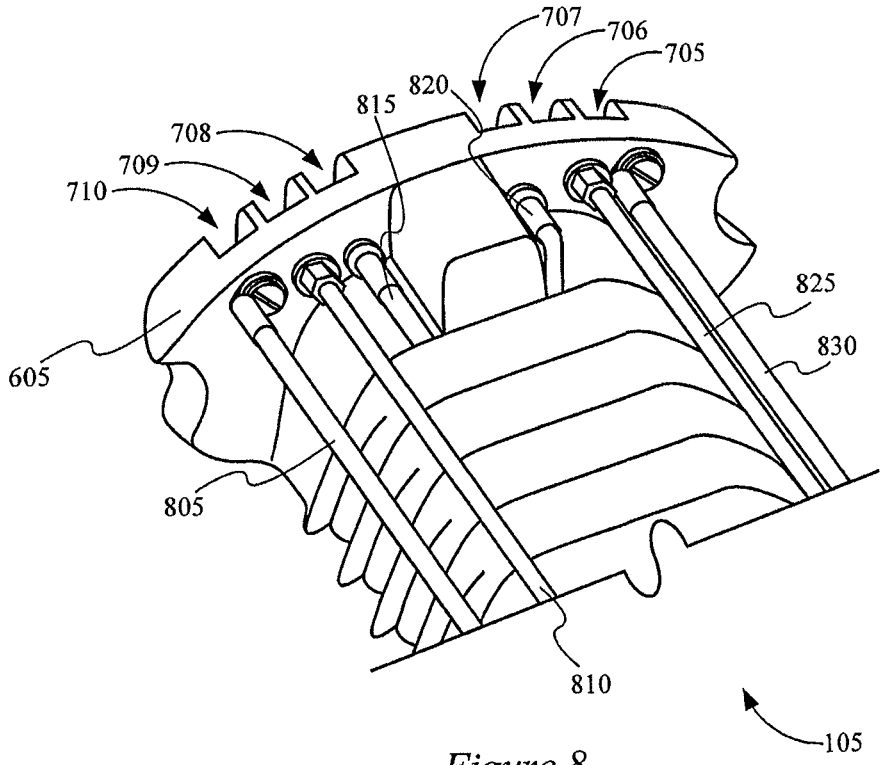
FIG. 8 is a perspective view of the interior of a rail according to some embodiments of the invention.

FIG. 8 is a partial perspective view of the interior of rail 105 with the outer rail housings removed. Wires 805, 810, 815, 820, 825, and 830 are shown which would extend through the passageways 1925 in the outer rail housings 1920, 1921. These wires individually or collectively can form the communication and/or power channels described elsewhere in this disclosure. These wires can extend through the length of rail 105 and may electrically connect nodes through rail 105 (e.g., as shown in FIG. 4). Wires 815 and 820, for example, can be coupled with at least some of the LEDs disposed within rail 105. Wires 815 and 820 can include a neutral and a hot wire that conduct DC power to the LEDs. Wire 805 can be coupled with electrical connector 710, wire 810 can be coupled with electrical connector 709, wire 825 can be coupled with electrical connector 706, and wire 830 can be coupled with electrical connector 705. These wires can extend through the length of rail 105 and may electrically connect two nodes through rail 105 (e.g., as shown in FIG. 4). Wires 805 and 810, for example, can provide a power channel (e.g., power channel 145 shown in FIG. 1) that may include a hot and neutral wire that conducts either AC or DC power. In some embodiments, portions of the rail body may be used four ground. Wires 825 and 830 can provide a communication channel (e.g., communication channel 140 in FIG. 1). While only six wires and/or connections are shown, any number of connections and/or wires can be provided.

Rail 105 can include end cap 605 that can mechanically and electrically couple rail 105 with node 110. Embodiments of the end caps support a novel plug-and-play installation of embodiments of the system by providing a "hot shoe" like electrical connection with a node that does not require any wire splicing, twist on wire connectors, or even the connection of a wire harness and thus reduces installation time and the amount of such time that must be performed by a licensed electrician.

Figure 9:
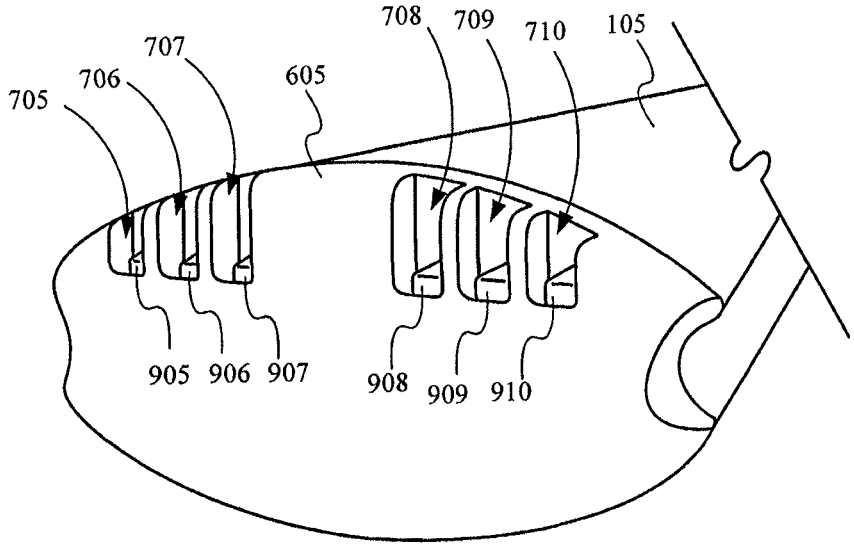
FIG. 9 is a perspective view of the end of a rail according to some embodiments of the invention.

End cap 605 includes a plurality of electrical connectors 705, 706, 707, 708, 709, 710 for connecting with wires 805, 810, 815, 820, 825, and 830. In this example, six separate electrical connections are shown, but any number of electrical connections may be used. Each electrical connector can be coupled with a wire within rail 105. In some embodiments, each electrical connector can include a slot formed within end cap 605. Corresponding electrical connectors in a node connector can extend within these slots to make an electrical connection. Electrically conductive bushings (905, 906, 907, 908, 909, and 910, see FIG. 9) can be disposed within each of these slots. These bushing may include spring action that provides a contact force onto a connector when connected.

Figure 10:
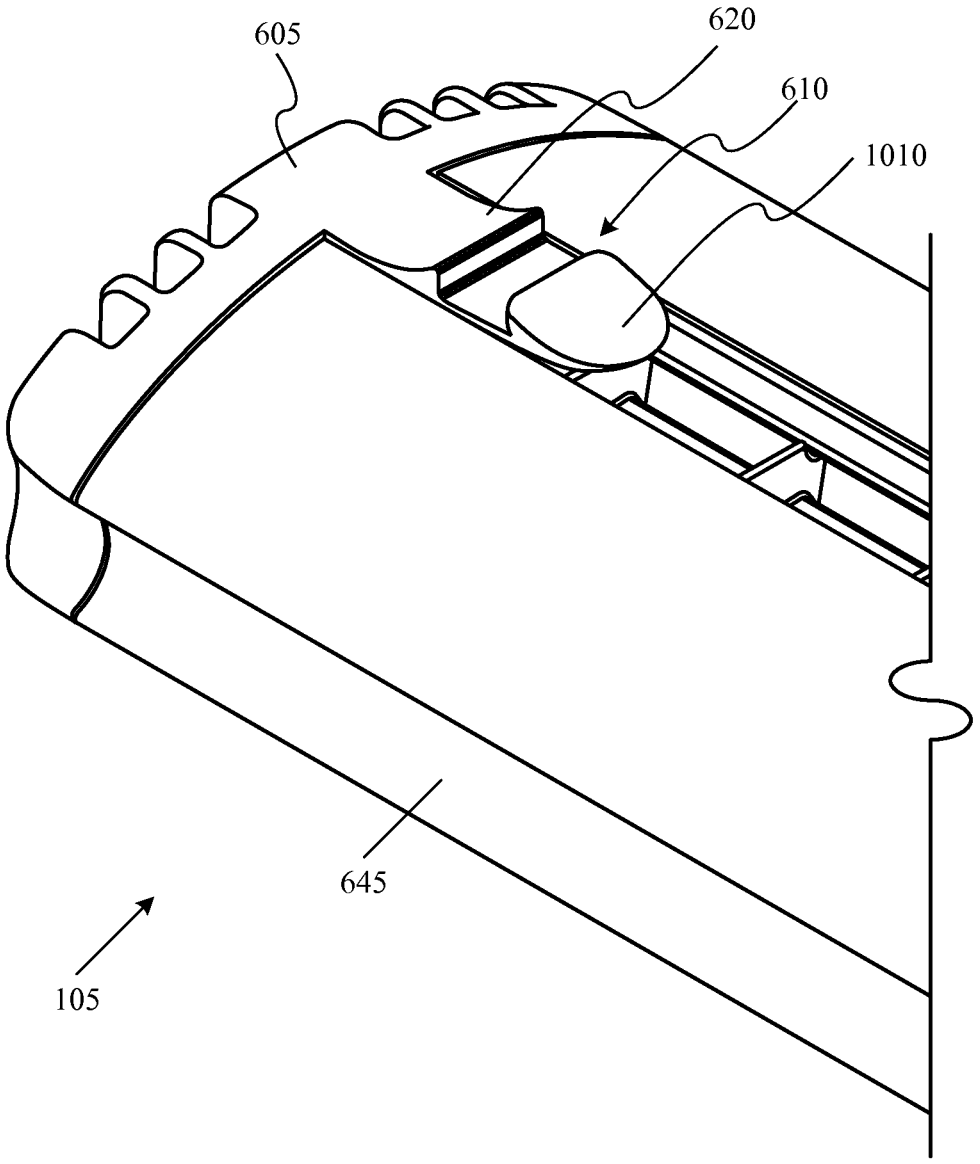
FIG. 10 is a perspective view of the end of a rail according to some embodiments of the invention.

The end cap 605 may be provided with a button 610 that includes an engagement portion 620 and release portion 1010. Button 610 can be used to couple rail 105 with node 110 and release rail 105 from node 110, as described below. As shown in FIG. 10, button may be positioned within rail channel 2020 of the rail 105.

The end cap may be formed of any suitable material, including but not limited to plastic, aluminum, etc.

Embodiments of Rail and Node Assemblies

To connect a rail to a node, rail 105 is inserted into a rail receiving port 665 of the node 110. Alignment arms 670 on node 110 may be provided to facilitate alignment and insertion of rail 105 into node 110. The inner surface of the alignment arms 670 may be contoured to mate with the outer surface of the outer rail housings 1920, 1921 and thereby ensure proper alignment between the rail and the node. The alignment arms 670 also help to mechanically support the rail 105.

Figure 6A:
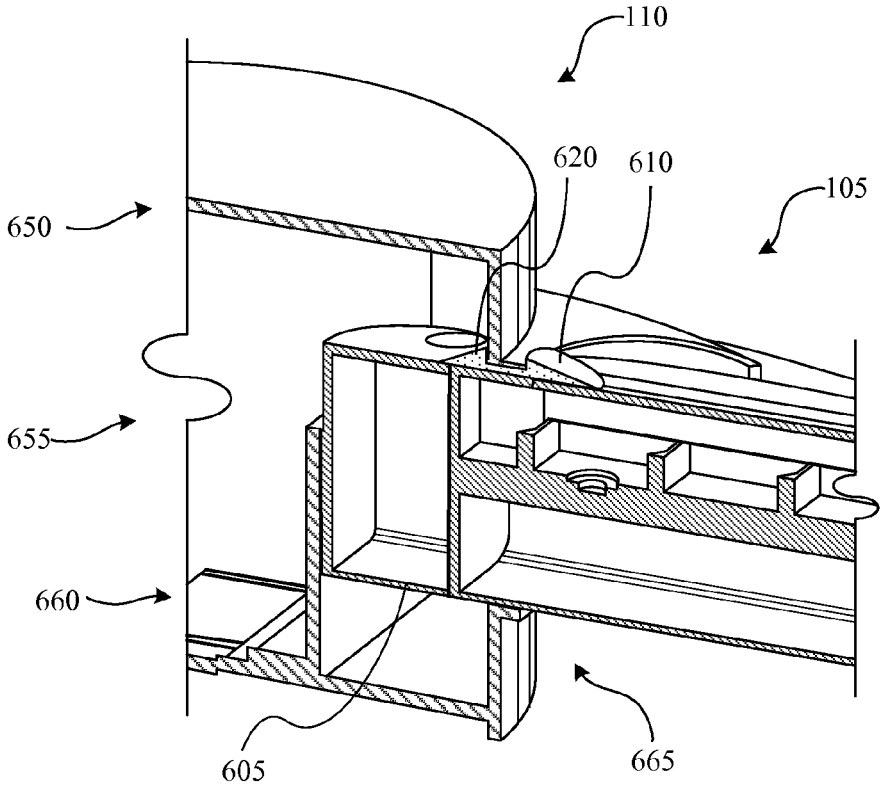
FIG. 6A is a cut way view of a rail coupled with a node according to some embodiments of the invention.
Figure 6B:
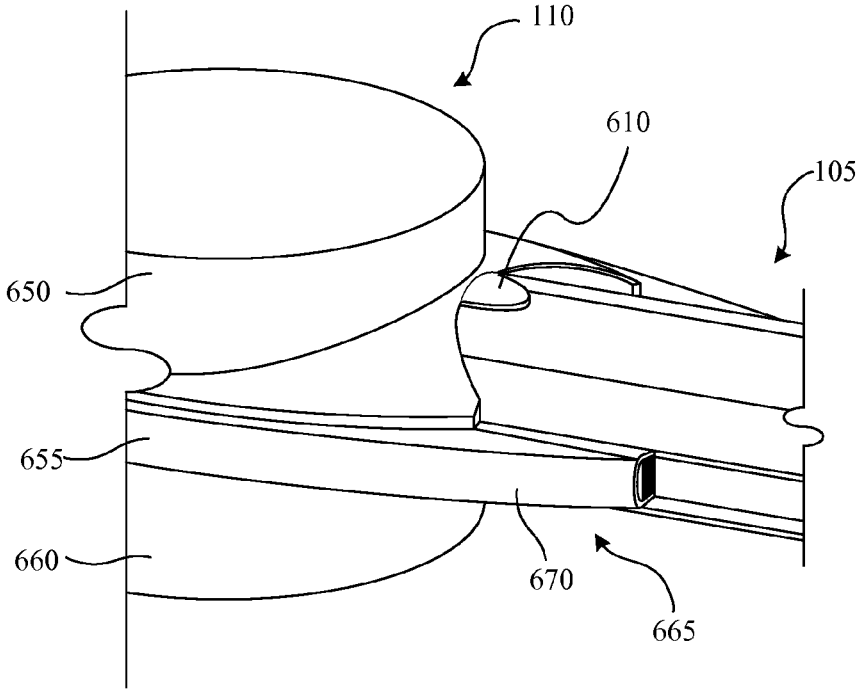
FIG. 6B is a rail coupled with a node according to some embodiments of the invention.
Figure 7:
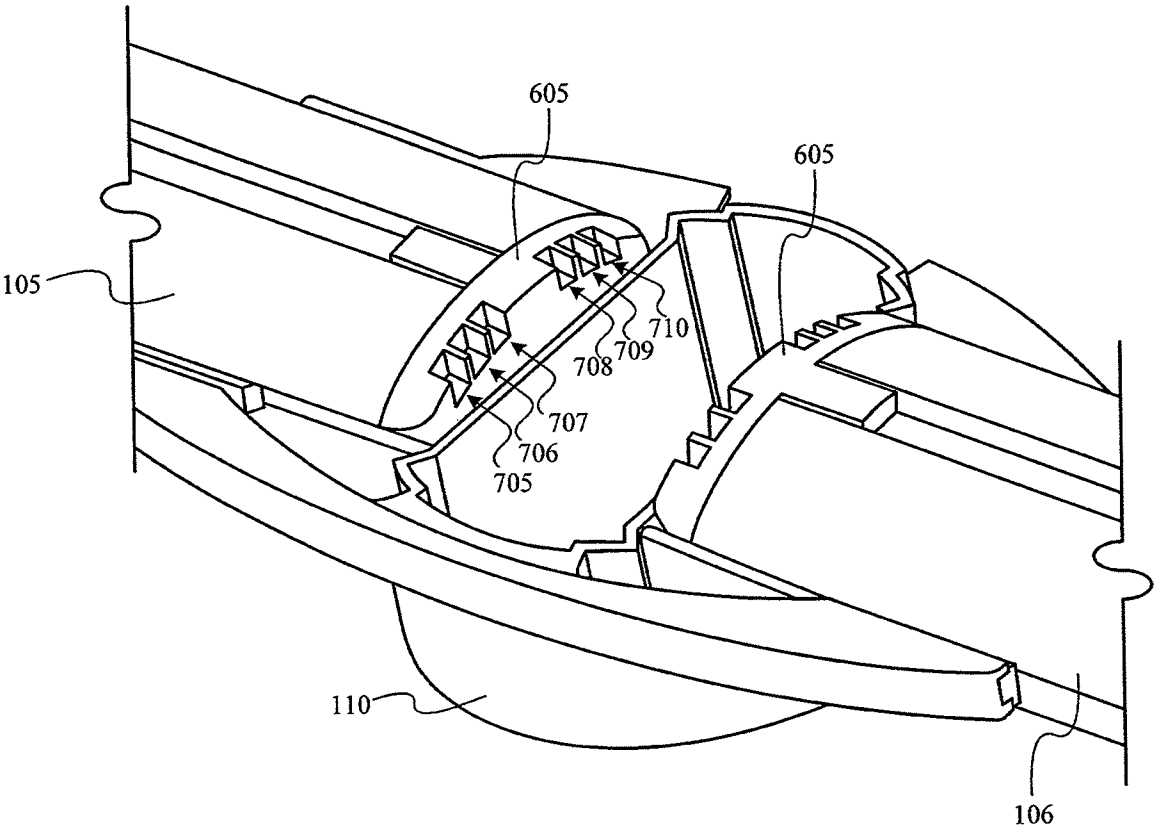
FIG. 7 is a cutaway perspective view of two rails coupled with a node according to some embodiments of the invention.

A rail 105 can be mated with node 110, as shown in FIGS. 6A, 6B and 7. FIG. 6A is a cut way view of rail 105 coupled with node 110, and FIG. 6B is a perspective view of rail 105 coupled with node 110. When the rail is properly inserted into the node, electrical connectivity is effectuated between the rail and the node via engagement of the node electrical connectors (not shown) with the electrical connectors 705, 706, 707, 708, 709, 710 on the end cap 605 of the rail 105, as shown in FIG. 7. In some embodiments, a safety interlock mechanism can be used within node 110 to ensure that line voltage will not be exposed at a node receiving port unless the end of a rail has been fully engaged into that port.

Rail 105 can also include features to mechanically connect rail 105 with node 110. In some embodiments, the rail 105 and node 110 are releasably connected. For example, button 610 can be used to secure rail 105 in node 110. A user can connect rail 105 with node 110 by sliding rail 105 into node 110. During connection, button 610 on end cap can be depressed by the sliding action of the engagement portion 620 of button 610 against the node housing. When engagement portion 620 has slid past the node housing, button 610 releases and the engagement portion 620 abuts the node housing to lock the rail 105 into place. In this way, button 610 can be used to provide a tool-less engagement with a node. An auditory and tactile "click" when the rail is locked in the node serves as positive feedback to the user that a secure connection has been made.

The release portion 1010 of button 610 is still exposed after rail insertion and can be depressed to release the rail from the node. A user can disconnect rail 105 from node 110 by depressing the release portion 1010 of button 610 so that engagement portion 620 can slide below the node housing thereby extracting rail 105 from node 110. Various other engagement, removal, or connective mechanisms can be used in place of the illustrated embodiment or in conjunction with the illustrated embodiment.

Figure 21A:
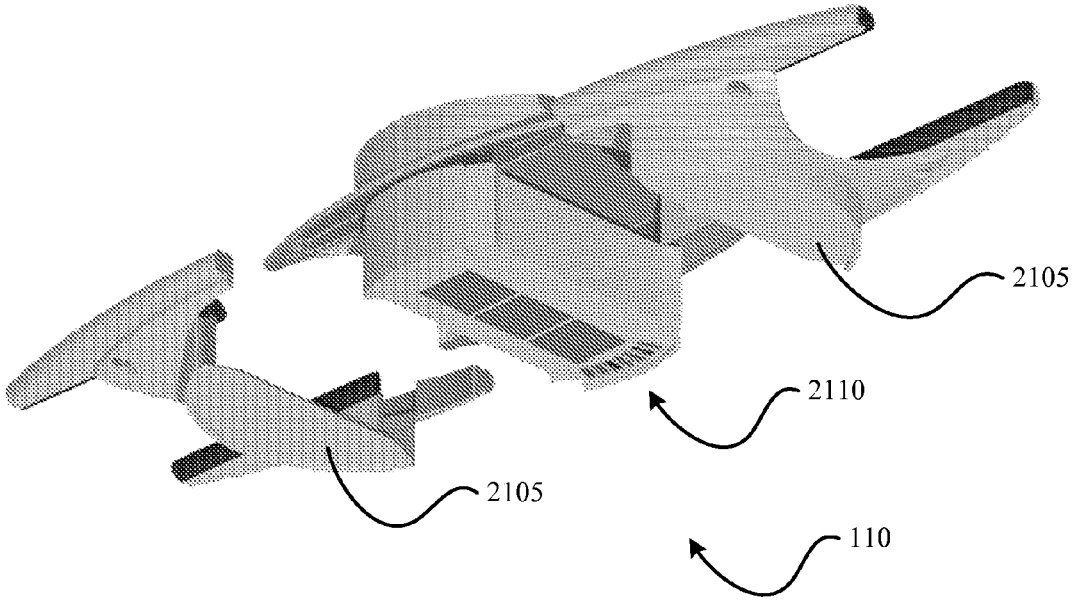
FIG. 21A is a perspective view of the outward removal of a bottom cuff of a receiving port from the main body of node according to some embodiments of the invention.
Figure 21B:
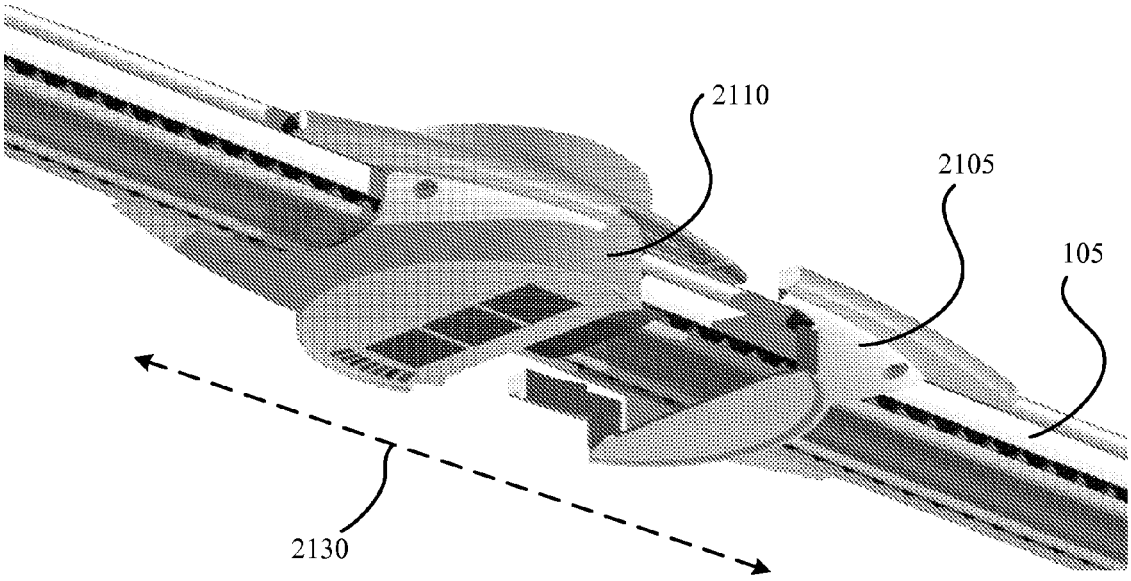
FIG. 21B is a perspective view of the bottom cuff of a receiving port being slid far enough along the rail to allow clearance for a downward disconnection of the rail from central body of node according to some embodiments of the invention.

Once a longer run of nodes and rails have been connected and mounted to the building structure, linear disassembly may not be efficiently feasible in the interior of the run. The nodes, therefore, can be provided with an alternative mechanism for mid-run disconnection. More specifically, the rail receiving ports could be separable from the central body 555 of the node 110. FIG. 21A shows the outward removal of the node cuffs 2105 from central body 2110 of node 110. As shown in FIG. 21B, the node cuff 2105 may be slid far enough along rail 105 to allow clearance for a downward disconnection of rail 105 from node 110. Safety interlock mechanisms in the end cap 605 and the node can prevent line voltage from being exposed at either location even if the other end of the rail or node is still energized. The replacement of any mid-run node or rail would follow a reverse procedure. This alternate method of engagement and disengagement of nodes and rails could potentially be used for first time assembly as well if the nodes were all rigidly mounted ahead of time. Nodes and rails can be coupled and retained without tools.

Embodiments of Connectors

The various traditional forms of mounting (e.g., conduit, surface, j-box, stem, threaded rod, jack chain, etc.) can be used for the lighting system. In some embodiments, a custom mounting device or connector can be used. One end of the connector would feature a means to attach via the aforementioned traditional mounting mechanisms. The other end of the connector would provide a custom mechanical connection to either a rail or a node. In the case of the rail, the connection would be able to be made at the time of installation anywhere along the top channel of the rail.

Figure 22B:
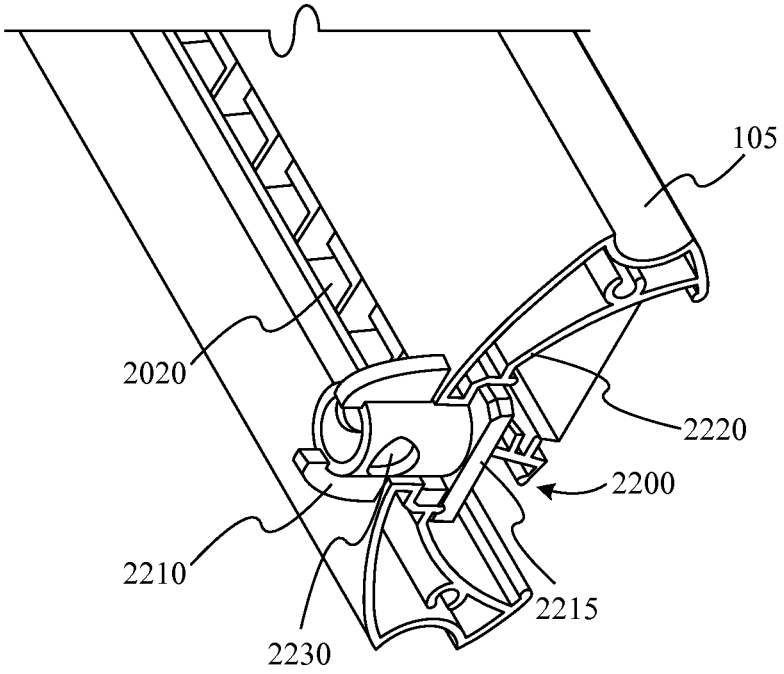
FIGS. 22A and 22B are perspective views showing rail connectors coupled with a rail according to some embodiments of the invention.
Figure 22A:
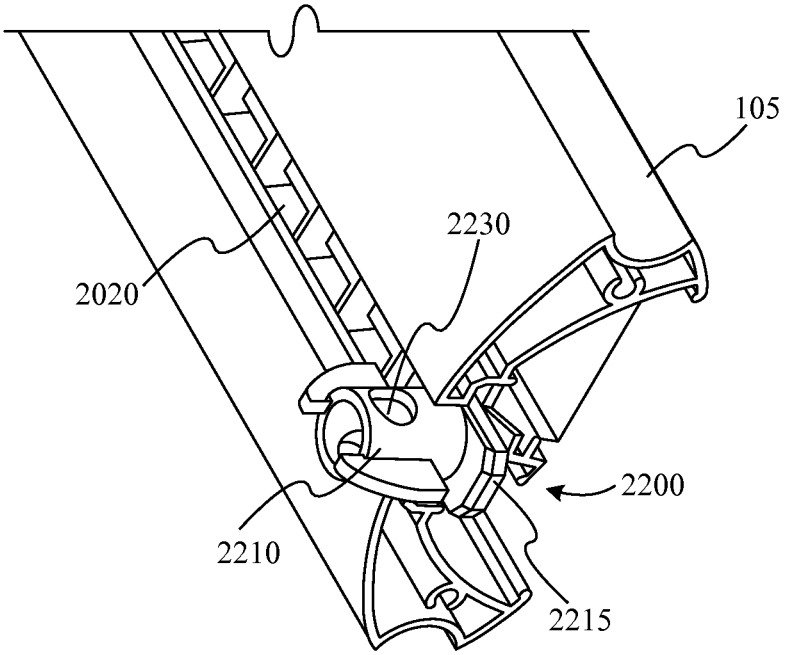

FIG. 22A illustrates an embodiment of such a connector and more specifically illustrates a twist-lock connector for connecting a luminaire rail with a building according to some embodiments of the invention. Connector 2200 can include an engagement member 2215 and a twist mechanism 2210 for rotating or otherwise altering the orientation of the engagement member 2215. Twist mechanism 2210 can include various wings or grips that can be used by a user to grab and twist connector 2200. Engagement member 2215 can have a largely rectangular shape with the length being greater than the width. The corners of engagement member 2215 can be rounded or angle cut to allow engagement member 2215 to turn within the rail channel 2020 of the rail.

To couple the connector 2200 to a rail 105, engagement member 2215 is oriented so that its longer dimension is aligned linearly with the channel (see FIG. 22A) and thus connector 2200 can slide along the length of rail 105 within rail channel 2020. When the connector 2210 is positioned at its desired location along the length of rail 105, the engagement member 2215 is rotated 90° (via rotation of the twist mechanism 2210) so that its longer dimension spans the width of the channel. Because the longer dimension of the engagement member 2215 is approximately the same as the width of the interior of channel 2205, connector 2200 is frictionally secured within channel 2205, as seen in FIG. 22B.

In some embodiments, an additional set screw can be used to secure connector 2200 to rail 105. Various other mechanisms can be used to ensure engagement.

Connector 2200 can also include an attachment mechanism for attaching connector 2200 (and the rail in which it is engaged) to a building with a typical mounting form (e.g., pendant pipe, threaded rod, aircraft cable, threaded hardware, chain tie-wire, wire, conduit, jack chain, etc.) to a building. The attachment mechanism can be as simple as hole 2230 within connector 2200.

While this disclosure focuses on the end-to-end linear embodiment, there are natural permutations that make use of the same novel two component architecture. One such configuration would include the use of nodes whose two rail receiving ports are oriented at less than 180 degrees from each other. This would allow for a run of rails and nodes to have angled sections and thus be able to turn corners, follow a perimeter or other non-linear architectural feature, form an extended geometric figure such as a rectangle or square, etc. Such nodes may be designed at fixed angles, or the receiving ports could be made rotatable about the center of the node to provide field adjustable angularity of the connected rails. Another example of a natural permutation is the use of a single node with just two connected rails. This would allow for a design that is somewhere in between a mono-point and truly linear configuration. A node with more than two receiving ports provides yet another permutation example. For instance a node with four receiving ports could serve as a singular unit with just four attached rails or could serve as an intersection point of a system comprised of linear runs oriented in two orthogonal dimensions.

Embodiments of Secondary Lighting

Embodiments of the invention can also include secondary lighting functions. Secondary lighting, for example, can include lighting that is distinct, different, and/or provides a different photometric distribution than the primary lighting. In embodiments, secondary lighting can include, for example, night lighting and/or egress lighting. In embodiments of the invention that include primary light sources disposed in rails (e.g., as described above) secondary lighting can, for example, be disposed as part of the node. In some embodiments, secondary lighting can provide a photometric distribution that illuminates the architectural space differently or in contrast with than the primary lighting, and/or illuminates a different portion of the architectural space than primary lighting. In some embodiments, primary lighting can be configured to support one set of visual tasks while egress lighting can support another set of visual tasks.

FIG. 5 shows node 110 with secondary light sources: emergency egress light and/or night light 506. These light sources are secondary to the primary light sources within rails 105 and 106. In some embodiments, a single secondary light source may be included that performs both egress lighting and night lighting functions.

As noted above, primary lighting can be provided by the rails and can primarily be used to illuminate vertical shelving as shown in FIG. 11. That is, the majority of the light from a rail can illuminate the shelves while a small amount of light illuminates the aisle. Secondary lighting can perform an opposite function. That is, the majority of the light from secondary lighting can illuminate an aisle. Some examples of primary and secondary lighting illumination patterns are shown in FIGS. 25-28.

Egress lighting and night lighting are two examples of secondary lighting. These two types of lighting can be from separate light sources or combined in a single secondary lighting solution. An egress light and a nightlight, can perform generally the same function but may do it for different purposes, use different power sources, have different light sources, and/or may be triggered differently.

Figure 25B:
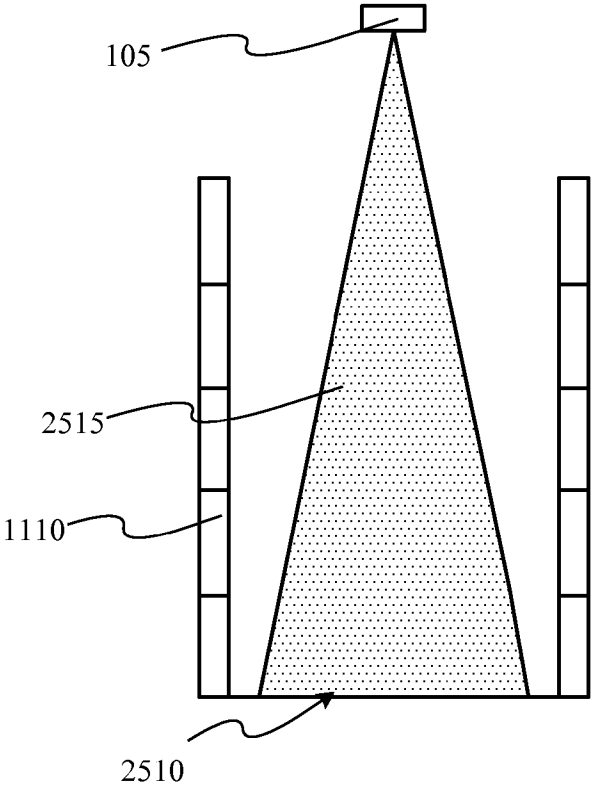
FIG. 25B shows an end view (e.g., across aisle view) of an illumination pattern generated from egress and/or an night light in a node according to some embodiments of the invention.
Figure 25A:
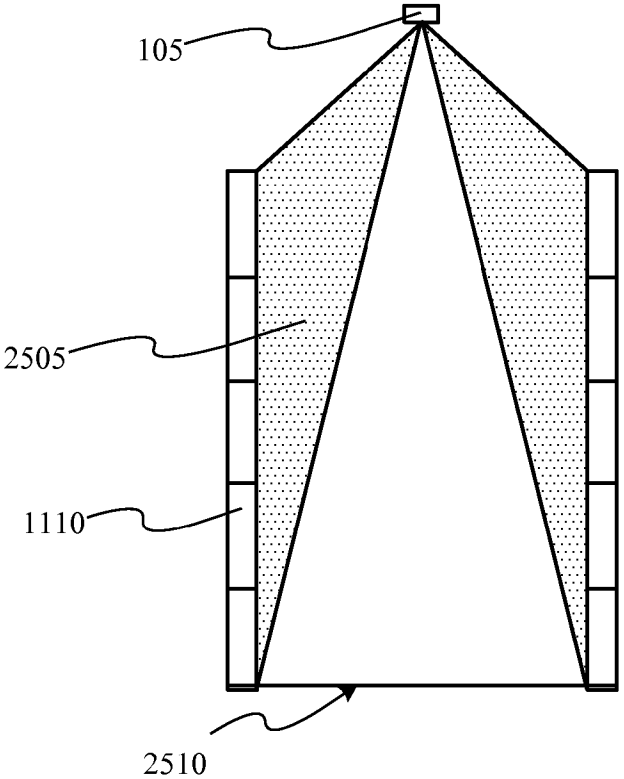
FIG. 25A shows an end view (e.g., across aisle view) of an illumination pattern generated from light sources in a rail according to some embodiments of the invention.

FIG. 25A shows the illumination pattern from primary lighting (LEDs in rail 105) and FIG. 25B shows a contrasting illumination patterns from secondary lighting (e.g., from LED or LEDs in node 110). FIG. 25A shows an end view (e.g., across aisle view) of an embodiment of an illumination pattern 2505 generated from primary lighting that can include light sources in rail 105. Illumination pattern 2505 is an idealized pattern representing how the majority of the light from the rail illuminates the architectural space. In this embodiment, the architectural space includes vertical shelving 1110 lining both sides of aisle 2510. While illumination pattern 2505 shows the majority of light illuminating vertical shelving 1110, in some embodiments, aisle 2510 may also be partially, completely, directly, and/or indirectly illuminated by primary lighting. The photometric distribution of light exiting rail 105 can be represented by the polar candela plot in FIG. 11.

FIG. 25B shows an end view (e.g., across aisle view) of an embodiment of an illumination pattern 2515 generated from a secondary lighting source, for example, located in node 110. Illumination pattern 2515 is an idealized pattern representing how the majority of the light from the node illuminates the architectural space. In this embodiment, the architectural space includes vertical shelving 1110 lining both sides of aisle 2510. The majority of light from illumination pattern 2515 illuminates aisle 2510. In some embodiments, vertical shelving 1110 can also be partially, completely, directly, and/or indirectly illuminated by secondary lighting, but to a lesser degree.

Figure 26:
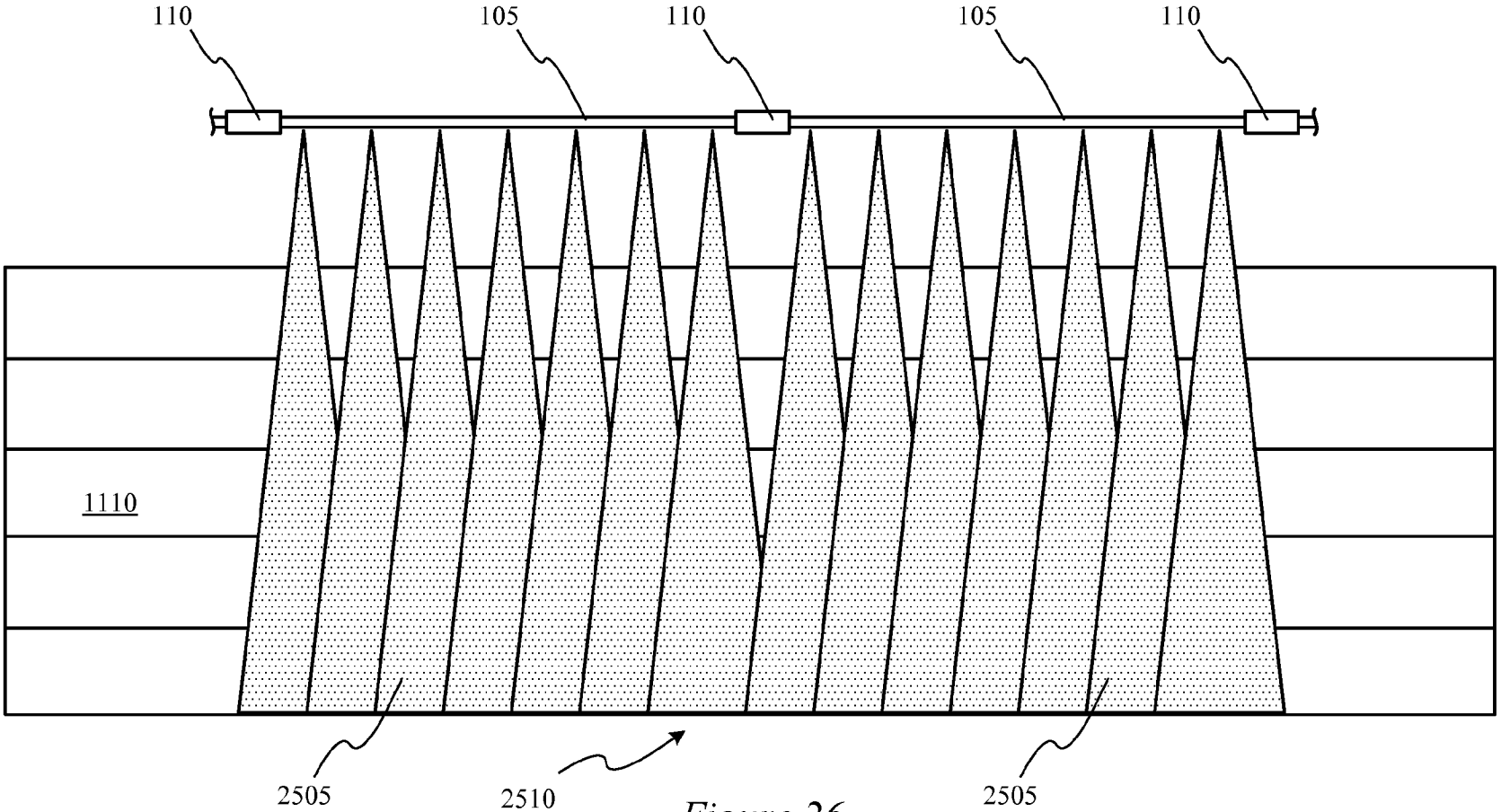
FIG. 26 shows the side view (e.g., along aisle view) of an illumination pattern generated from a plurality of light sources in a rail according to some embodiments of the invention.
Figure 27:
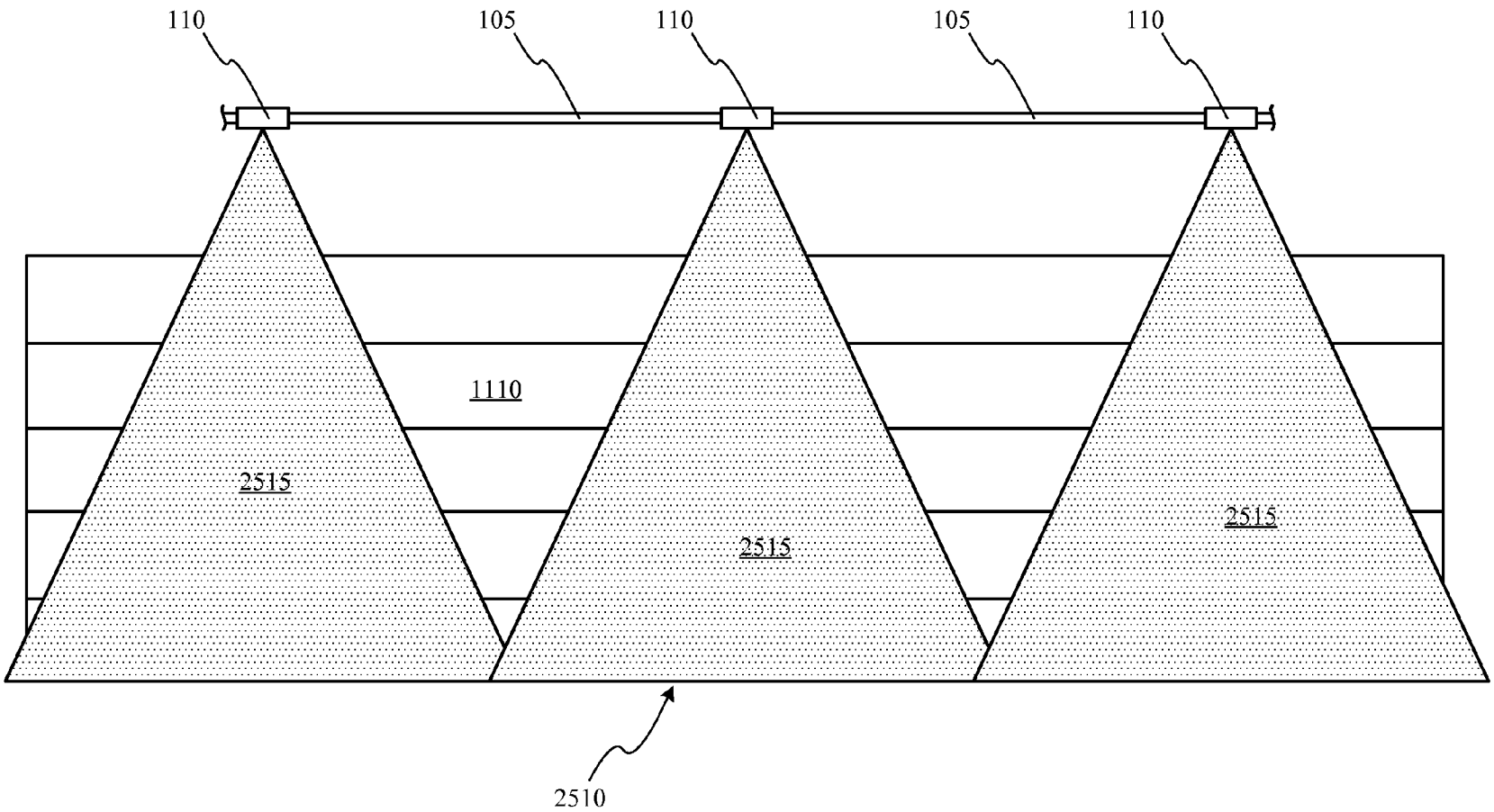
FIG. 27 shows the side view (e.g., along aisle view) of an illumination pattern shown generated from an egress light in nodes according to some embodiments of the invention.

FIG. 26 shows the illumination pattern of from primary lighting (e.g., from LEDs in rail 105) and FIG. 27 shows a contrasting illumination pattern from secondary lighting (e.g., from LED or LEDs in node 110). FIG. 26 shows a side view (e.g., along aisle view) of an embodiment of an illumination pattern 2505 generated from primary lighting that can include light sources in rail 105. Illumination pattern 2505 provides continuous illumination along vertical shelves 1110. FIG. 27 shows a side view (e.g., along aisle view) of illumination pattern 2515 generated from secondary lighting. Illumination pattern 2515 provides continuous illumination down aisle 2510. As represented by illumination pattern 2515, illumination provided by secondary lighting can be spread along a length of aisle 2510. In some embodiments, the length of the illumination pattern from a single secondary light source can include four feet, six feet, eight feet, ten feet, twelve feet, or fourteen feet along the length of aisle 2510. Moreover, a plurality of secondary light sources together can be illuminate the length of aisle 2510.

As represented by illumination pattern 2515, illumination provided by secondary lighting can be spread along a width of aisle 2510. In some embodiments, illumination provided by secondary lighting can be partially spread along the width of aisle 2510. In some embodiments, the illumination from secondary lighting can be centered around or near the center of the aisle. In some embodiments, secondary lighting can illuminate over a width of aisle 2510. In some embodiments, this width can be, for example, four feet, six feet, eight feet, ten feet, twelve feet, or fourteen feet.

Figure 28A:
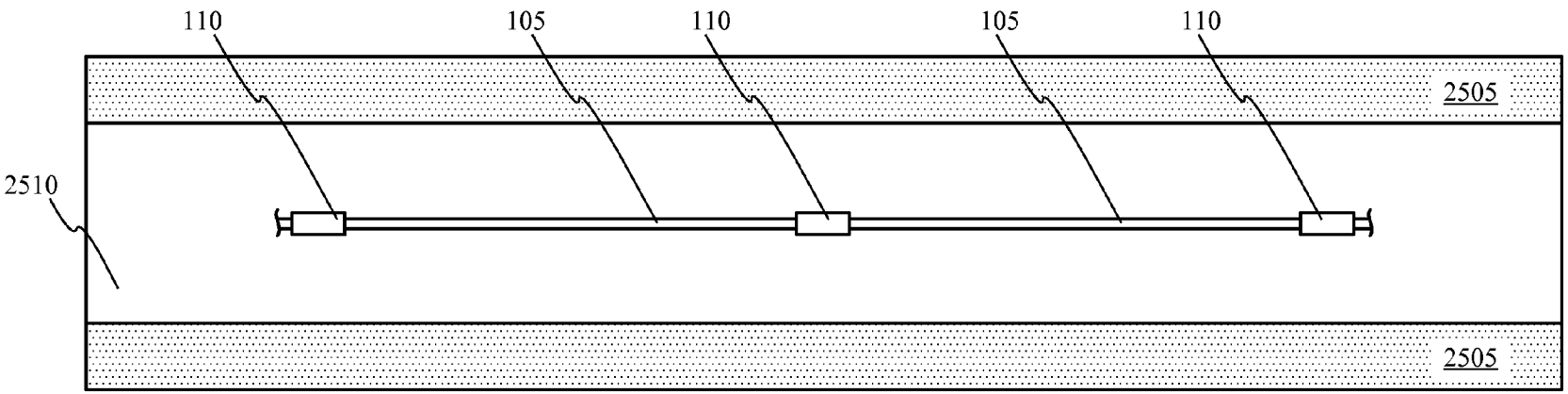
FIG. 28A shows the top view of an illumination pattern from rails according to some embodiments of the invention.
Figure 28B:
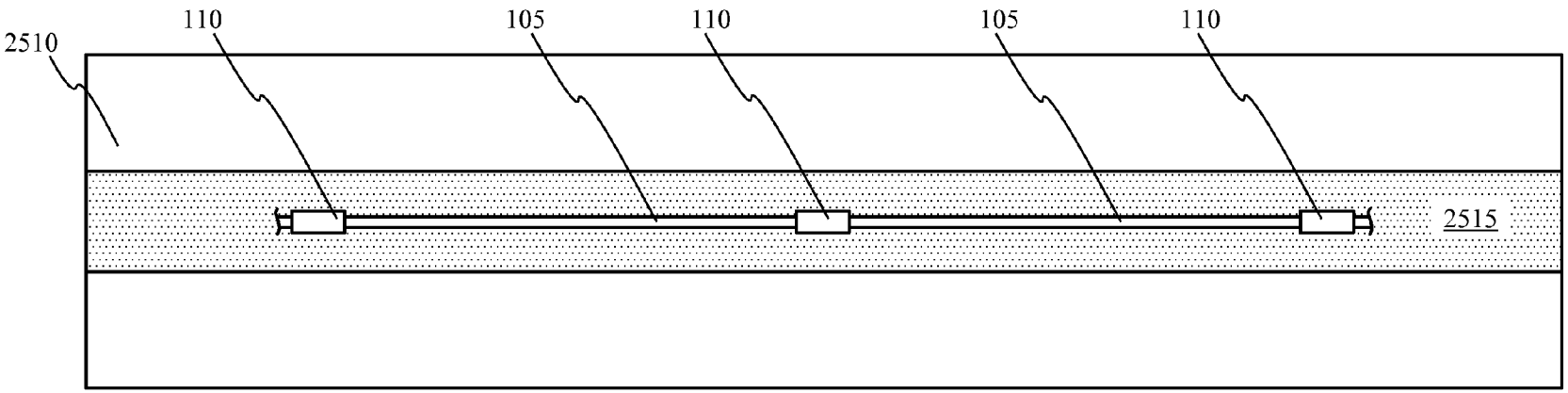
FIG. 28B shows the top view of an illumination pattern from egress lights located in nodes according to some embodiments of the invention.

FIG. 28A shows a top view of an embodiment of an illumination pattern 2505 from primary lighting that can include light sources in rail 105, and FIG. 28B shows a top view of an embodiment of an illumination pattern 2515 from secondary lighting that can include secondary light sources in node 110. Illumination pattern 2505 shows how the majority of light from primary lighting can illuminate both sides of aisle 2510 and/or vertical shelving that lines the aisle. This pattern can be used to illuminate shelves 1110. Illumination pattern 2515 shows how the majority of light from secondary lighting illuminates the center of aisle 2510. As noted above, illumination pattern 2505 and illumination pattern 2515 are idealized representations of the photometric distribution generated by primary lighting and secondary lighting. The actual magnitude, size, shape, and intensity of light distribution illuminating aisle 2510 may vary (e.g., by angle). Moreover, even though illumination patterns 2505 and 2515 show portions of aisle 2510 that are not illuminated, these areas can still be illuminated. The actual illumination patterns 2505, 2515 may also not have well-defined boundaries and/or may not have straight edges as shown.

The illumination patterns shown in FIG. 28A and FIG. 28B are contrasting illumination patterns. As shown in FIGS. 28A and 28B, primary lighting from rail 105 distributes light produced by the LEDs along the edges of an aisle that may include shelving, while node 110 distributes light from secondary lighting along the floor of the aisle.

Node 110 can include optics and/or LEDs in conjunction with secondary lighting. These optics can collimate and/or focus the light from an LED or from LEDs in order to provide an illumination pattern similar to illumination pattern 2515. These optics, for example, can control the photometric distribution of light to form a path along the length and/or width of an aisle Secondary lighting may illuminate aisle 2510 with a lower intensity than the illumination of the vertical shelves by primary lighting. An observer may find aisle 1510 more dimly lit when illuminated by secondary lighting than the illumination of shelves 1110 by primary lighting. Moreover, in some embodiments, an observer may find aisle 2510 more dimply lit when illuminated by secondary lighting than when illuminated by primary lighting.

Secondary lighting can provide illumination along an aisle during an emergency and/or during times of darkness, for example, when light sources within the rails are off. Secondary lighting can be turned on or off based on a number of factors singularly or in combination. For example, secondary lighting, in a nightlight function, can be automatically turned on when motion from an object is detected by a motion detector near or within the node. As another nightlight-like example, secondary lighting can be automatically turned on when a photosensor detects darkness within the area near the node. As another example, secondary lighting can be automatically turned on only during certain times of day. As another example, secondary lighting can be automatically turned on when a smoke detector detects smoke. As another example, secondary lighting can be automatically turned on when power to the primary lighting is off. As another example, secondary lighting can be automatically turned on when light sources with rails are turned off. Each of the previously mentioned scenarios can be implemented with a controller. The controller can receive input from the various sensors and make a determination whether to turn on the egress light.

In some embodiments, secondary lighting can be used for emergency lighting purposes. For example, a secondary lighting can provide emergency egress lighting. Egress lighting, for example, can be coupled with an independent power supply and/or controller that is separate and distinct from the power supply and/or controller that is coupled with the light sources within the rails. In this way, egress lighting can be turned on or off even when the power supply and/or control coupled with the rails are inoperative. An independent power supply can include a single battery coupled with each light source, a generator system, or a battery coupled with multiple egress light sources.

In some embodiments, secondary lighting can include two light sources (e.g., LEDs) and a single optical element (e.g., a lens). One of the two lights can be used for egress functions and/or can be coupled to an independent power supply. The other of the two light sources can be used for night light purposes and can be coupled with the same power supply that powers primary lighting.

While embodiments of the invention have shown secondary lighting primarily disposed within a node and the primary lighting primarily disposed within rails, this is not required. Secondary lighting and/or primary lighting can be disposed in any number of configurations. For example, secondary lighting and primary lighting can be disposed within a single housing, for example, within rail.

Various embodiments of the invention have been described. These embodiments are examples describing various principles of the present invention. Numerous modifications and adaptations thereof will be readily apparent to those skilled in the art without departing from the spirit and scope of the invention. For example, the concepts described herein need not be limited to rail and node lighting applications.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A light fixture comprising:

a. a primary lighting subsystem adapted to emit light to illuminate an architectural space with a first illumination pattern, wherein the primary lighting subsystem comprises:

at least one rail having a length and an end;

a plurality of LEDs disposed along the length of the at least one rail; and an optical element disposed along the length of the at least one rail and positioned to distribute the light emitted from the primary lighting subsystem in the first illumination pattern, and b. a secondary lighting subsystem adapted to emit light to illuminate the architectural space with a second illumination pattern different from the first illumination pattern, wherein the secondary lighting subsystem comprises at least one node mechanically coupled with the end of the at least one rail, wherein the light fixture activates only one of the primary lighting subsystem and the secondary lighting subsystem at a time.

2. The light fixture of claim 1, wherein the architectural space comprises a vertical component having a height and a length and a horizontal component having a width and a length, wherein a majority of the light emitted from the primary lighting subsystem illuminates at least a portion of the vertical component, and wherein a majority of the light emitted from the secondary lighting subsystem illuminates at least a portion of the horizontal component.

3. The light fixture of claim 2, wherein the horizontal component comprises a floor and the vertical component comprises at least one vertical shelf positioned with respect to the floor.

4. The light fixture of claim 3, wherein the at least one rail extends above at least a portion of the length of the floor.

5. The light fixture of claim 1, wherein the at least one rail comprises two adjacent rails and wherein the at least one node is interposed between, and mechanically coupled to, the ends of the two adjacent rails.

6. The light fixture of claim 1, wherein the at least one node is removably coupled with the end of the at least one rail.

7. The light fixture of claim 1, wherein:

the light fixture emits light toward a first plane and toward a second plane oriented substantially perpendicular to the first plane;

the primary lighting subsystem emits a majority of light from the plurality of LEDs in the first illumination pattern, wherein the first illumination pattern is directed toward the first plane;

the secondary lighting subsystem emits a majority of light in the second illumination pattern, wherein the second illumination pattern is directed toward the second plane; and the light fixture activates only one of the primary lighting subsystem and the secondary lighting subsystem at a time such that the majority of light emitted from the light fixture at any given time is directed either toward the first plane or toward the second plane.

8. The light fixture of claim 7, wherein the first plane extends substantially vertically and wherein the second plane extends substantially horizontally.

9. The light fixture of claim 8, wherein the first plane is defined by a vertical array of shelves such that the primary lighting subsystem emits the majority of light from the plurality of LEDs outwardly toward the shelves.

10. The lighting fixture of claim 8, wherein the second plane is defined by a floor such that the secondary lighting subsystem emits the majority of light downwardly toward the floor.

11. The light fixture of claim 7, wherein the primary lighting subsystem emits a minority of light from the plurality of LEDs toward the second plane.

12. The light fixture of claim 7, wherein the secondary lighting subsystem emits a minority of light toward the first plane.

13. The light fixture of claim 1, wherein the light emitted from the primary lighting subsystem comprises an angular distribution of luminous intensities, including an angle of peak intensity, and wherein the luminous intensity of light emitted at nadir is less than ½ of the luminous intensity emitted at the angle of peak intensity.

14. A light fixture for illuminating an architectural space having a vertical component and a horizontal component, the light fixture comprising:

a. a primary lighting subsystem that emits light and comprises:

i. a plurality of rails each having a length and an end;

ii. a plurality of LEDs disposed along the length of each of the plurality of rails; and iii. at least one optical element disposed along the length of each of the plurality of rails, wherein the at least one optical element of each rail is adapted to direct a majority of the light emitted from the rail towards the vertical component of the architectural space; and b. a secondary lighting subsystem that emits light and comprises at least one node interposed between, and mechanically coupled to, the ends of adjacent rails, wherein a majority of the light emitted from the at least one node illuminates at least a portion of the horizontal component, wherein the light fixture is adapted to activate only one of the primary lighting subsystem and the secondary lighting subsystem at a time.

15. The light fixture of claim 14, wherein the horizontal component comprises a floor and the vertical component comprises at least one vertical shelf positioned with respect to the floor.

16. The light fixture of claim 15, wherein at least some of the plurality of rails extend above at least a portion of the length of the floor.

* * * * *